US009320675B2

(12) United States Patent
Johnson

(10) Patent No.: US 9,320,675 B2
(45) Date of Patent: Apr. 26, 2016

(54) MASSAGE DEVICE AND MOUNTING BODY

(71) Applicant: Ronald B. Johnson, Casa Grande, AZ (US)

(72) Inventor: Ronald B. Johnson, Casa Grande, AZ (US)

( * ) Notice: Subject to any disclaimer, the term of this patent is extended or adjusted under 35 U.S.C. 154(b) by 657 days.

(21) Appl. No.: 13/747,066

(22) Filed: Jan. 22, 2013

(65) Prior Publication Data

US 2013/0190664 A1 Jul. 25, 2013

Related U.S. Application Data

(63) Continuation-in-part of application No. 13/438,775, filed on Apr. 3, 2012, which is a continuation-in-part of application No. 13/358,291, filed on Jan. 25, 2012, now Pat. No. 9,039,641.

(51) Int. Cl.
*A61H 15/00* (2006.01)

(52) U.S. Cl.
CPC ..... *A61H 15/00* (2013.01); *A61H 15/0092* (2013.01); *A61H 2015/005* (2013.01); *A61H 2015/0064* (2013.01); *A61H 2201/0123* (2013.01); *A61H 2201/1284* (2013.01); *A61H 2201/1695* (2013.01); *A61H 2205/081* (2013.01)

(58) Field of Classification Search
CPC ..... A61H 15/00; A61H 15/0092; A61H 2015/0042; A61H 2015/0007; A61H 7/00; A61H 7/003; A61H 7/007; A61H 2201/0119; A61H 2201/0123; A61H 2201/1284; A61H 2201/1692; A61H 1/008; A63B 21/00047; A63B 21/0005; A63B 21/16; A63B 21/4033; A63B 41/00; A63B 43/02
USPC ..... 446/168, 170; 248/346.01, 346.03, 248/346.5
See application file for complete search history.

(56) References Cited

U.S. PATENT DOCUMENTS

| | | | | |
|---|---|---|---|---|
| 563,170 | A | 6/1896 | Haley et al. | |
| 744,718 | A | 11/1908 | Cassidy | |
| 2,078,382 | A | 4/1937 | Hanshaw | |
| 2,362,064 | A | 11/1944 | Giesinger | |
| 2,466,470 | A | 4/1949 | Norris | |
| 4,622,956 | A * | 11/1986 | Nesheim | A61H 15/0092 601/119 |
| 4,846,159 | A * | 7/1989 | Anzai | A61H 15/00 601/118 |

(Continued)

FOREIGN PATENT DOCUMENTS

| | | |
|---|---|---|
| DE | 29701582 | 9/1997 |
| TW | M279334 | 11/2005 |

OTHER PUBLICATIONS

"Pentakis Dodecahedron" Wikipedia. Mar. 12, 2001.

(Continued)

*Primary Examiner* — Justine Yu
*Assistant Examiner* — Christopher Miller
(74) *Attorney, Agent, or Firm* — Booth Udall Fuller, PLC

(57) ABSTRACT

A massage device mounting system may include a massage ball with a plurality of massage fingers positioned across the ball aligned with the vertices of a pentakis dodecahedron. The massage device mounting system may also include a mounting body removably entrapped between a plurality of massage fingers on the massage apparatus. The mounting body may include a mounting shoulder with a continuous or discontinuous ring. The mounting shoulder may also be circular shaped or polygonal shaped. The mounting body may also include one or two handles coupled to the mounting shoulder. Some mounting bodies may also include a mounting base that can mount to a mounting wall.

34 Claims, 34 Drawing Sheets

(56) References Cited

U.S. PATENT DOCUMENTS

| | | | | |
|---|---|---|---|---|
| D317,805 | S | 6/1991 | Swan | |
| 5,028,053 | A | 7/1991 | Leopold | |
| 5,131,665 | A | 7/1992 | Myers | |
| 5,251,908 | A | 10/1993 | Myers | |
| D358,858 | S | 5/1995 | McGreevy | |
| D435,660 | S | 12/2000 | Yoo | |
| 6,245,031 | B1 | 6/2001 | Peasron | |
| D456,570 | S | 4/2002 | Tsengas | |
| 6,443,863 | B1 | 9/2002 | Dinoffer | |
| D478,367 | S | 8/2003 | Traub | |
| D516,640 | S | 3/2006 | Shore | |
| 7,238,161 | B2 | 7/2007 | Komkin et al. | |
| 7,413,524 | B1 | 8/2008 | Bibby | |
| 7,458,945 | B2 | 12/2008 | Zemont | |
| D585,162 | S | 1/2009 | Partain et al. | |
| D599,963 | S | 9/2009 | Crane et al. | |
| D601,645 | S | 10/2009 | Chapa, Jr. | |
| 7,691,036 | B1 * | 4/2010 | Julian | A61H 1/0292 482/110 |
| D617,395 | S | 6/2010 | Colangelo et al. | |
| D619,663 | S | 7/2010 | Quinn | |
| D625,426 | S | 10/2010 | Robins | |
| D626,610 | S | 11/2010 | Grimm | |
| D629,056 | S | 12/2010 | Grimm | |
| 2003/0181836 | A1 * | 9/2003 | Cameron | A61H 15/00 601/115 |
| 2004/0256532 | A1 * | 12/2004 | Liao | A47C 3/16 248/346.01 |
| 2005/0033205 | A1 * | 2/2005 | Komkin | A61H 15/0092 601/131 |
| 2005/0227838 | A1 * | 10/2005 | Friesen | A63B 43/02 482/148 |
| 2006/0161080 | A1 * | 7/2006 | Chen | A61H 7/003 601/131 |
| 2010/0087763 | A1 * | 4/2010 | Hane-Karr | A61H 7/007 601/137 |
| 2010/0331154 | A1 * | 12/2010 | Taylor | A63B 26/003 482/142 |
| 2011/0111934 | A1 * | 5/2011 | Taylor | A63B 26/003 482/139 |
| 2011/0160024 | A1 * | 6/2011 | Candela | A63B 23/0211 482/132 |
| 2012/0104214 | A1 * | 5/2012 | St. Jacques | A01K 5/0135 248/346.5 |
| 2013/0090583 | A1 * | 4/2013 | Jung | A61H 15/00 601/131 |
| 2013/0184131 | A1 * | 7/2013 | Doyle | A63B 21/00 482/139 |
| 2014/0336550 | A1 * | 11/2014 | Zedaker | A61H 7/007 601/131 |

OTHER PUBLICATIONS

"Massage Tool for Back Pain Neck Pain Sore Muscles" Healthy Body Ball. http://www.healthybodyball.com.

* cited by examiner

MASSAGE DEVICE AND MOUNTING BODY

CROSS REFERENCE TO RELATED APPLICATIONS

This is a continuation-in-part application of pending patent application Ser. No. 13/438,775 to Johnson, filed Apr. 3, 2012 and titled "MASSAGE DEVICE AND REMOVABLE MOUNTING SYSTEM," which application is a continuation-in-part application of pending patent application Ser. No. 13/358,291, to Johnson filed Jan. 25, 2012 and titled "MASSAGE APPARATUS," the disclosures of which is hereby incorporated herein by reference.

BACKGROUND

1. Technical Field

Aspects of this document relate generally to body massaging apparatuses and support structures for body massaging apparatuses.

2. Background Art

Massage balls and other apparatus are often used to treat or relax muscles. Typical massage balls comprise a ball with various points or knobs placed sporadically or in some pattern across the surface of the ball. These and other massage balls pose several problems in the utilization of the massage ball. First, if the massage ball has points or knobs that are too close together or too small, the massage ball is not effective in muscle treatment. When a ball with too many points or knobs is rolled over a muscle, the muscle recognizes or responds to only a spherical shape because of the close proximity of the relative contact points. Thus, the knobs or points are rendered useless. Second, massage balls with too few points or knobs do not roll smoothly. As a result, the knobs or points typically apply too much pressure in a disjointed fashion before sporadically rotating to the next knob or point in contact with the body. This is particularly the case for massage balls which are used in a fashion where they are placed on the ground and the user rolls the ball between the user's body and the ground or other firm surface. Sporadic or uneven rolling makes it difficult to treat the muscle predictably. Third, some massage balls are inflatable or air-filled apparatuses. These apparatuses, however, are prone to collapsing under pressure when applied in use. The collapse prevents effective use of the massage ball.

The effectiveness of a massage apparatus may be further enhanced by proper use. Typical massage apparatuses are limited to only certain positions without the assistance of another individual or apparatus.

SUMMARY

A first aspect of a massage device mounting system comprises a massage ball and a mounting body. The massage ball comprises a plurality of massage fingers, and each massage finger may comprise a center axis central to an outward tip of the massage finger and extending to a center of the massage ball. The mounting body comprises a mounting shoulder removably entrapped between a plurality of fingers of the plurality of flexible massage fingers. The mounting shoulder comprises an inner boundary that surrounds at least a majority of a portion of the massage ball.

In particular implementations and embodiments, the massage device mounting system may comprise one or more of the following. The plurality of massage fingers may comprise thirty-two massage fingers and each center axis may be positioned to correspond to a location of a different one of thirty-two vertices of a pentakis dodecahedron. The mounting shoulder may be removably entrapped on the massage ball between at least three fingers of the thirty-two fingers directly contacting the inner boundary of the mounting shoulder and at least three fingers of the thirty-two fingers may directly contact an outer surface of the mounting shoulder. At least one handle may be coupled to the mounting body. The mounting shoulder may comprise a continuous ring and the at least one handle may comprise two handles on opposing sides of the continuous ring. The mounting body may comprise a cylindrical mounting body coupled to the continuous ring of the mounting shoulder. The mounting shoulder may comprise a discontinuous ring and the at least one handle may comprise one handle coupled to the discontinuous ring. The handle may comprise a J-shaped element with a first end coupled to the discontinuous ring and a terminating end opposite the base. A hook may be on the terminating end of the J-shaped element and a reentrant opening may be on the J-shaped element positioned between the terminating end and the first end. The discontinuous ring may comprise a substantially circular discontinuous ring. The discontinuous ring may comprise a polygonal discontinuous ring. The mounting body may comprise a substantially planar mounting plate with an opening defined by the inner boundary of the mounting shoulder. The mounting body may be positioned on a mounting base. The mounting shoulder may comprise a continuous ring and the mounting base may extend from the mounting shoulder to form a mounting chamber. The mounting base may further comprise a coupling opposite the mounting shoulder. The mounting base may further comprise a plurality of finger apertures extending through the mounting base. Each finger aperture may be positioned to allow a different mounting finger of the plurality of mounting fingers to extend therethrough when the massage ball is entrapped within the mounting shoulder. The mounting shoulder may comprise a circular ring positioned on a cylindrical body of the base. The circular ring may comprise a discontinuous ring comprising a plurality of segments separated by a plurality of reentrant openings, each reentrant opening sized to allow passage of one of the plurality of massage fingers through the mounting shoulder.

A second aspect of a massage device mounting system comprises a mounting body and a massage apparatus. The mounting body comprises a massage apparatus mounting shoulder. The massage apparatus comprises an array of flexible massage fingers positioned to removably entrap the mounting shoulder between at least a first plurality of massage fingers of the array of flexible massage fingers and a second plurality of massage fingers of the array of flexible massage fingers. Each massage finger of the array of flexible massage fingers comprises a center axis central to an outward tip of the massage finger and extending to a center of the massage apparatus. Each center axis is positioned to correspond to a different vertex of a pentakis dodecahedron having the same center as the massage apparatus.

In particular implementations and embodiments, the massage device mounting system may comprise one or more of the following. The first plurality of massage fingers may comprise at least three fingers on the massage device positioned to contact an inner boundary of the mounting shoulder and the second plurality of massage fingers may comprise at least three fingers positioned to contact an outer surface of the mounting shoulder when the mounting shoulder is removably entrapped on the mounting body. The mounting body may comprise a cylindrical mounting body coupled to the mounting shoulder. Two handles may be coupled to opposing sides of the cylindrical mounting body. The massage apparatus mounting device may comprise a mounting base coupled to the cylindrical mounting body opposite the mounting shoulder. The mounting base may comprise a plurality of post receivers and the massage device mounting system may comprise a track comprising at least one channel and a mounting clamp removably coupled to the track and removably coupled to the mounting base, the mounting clamp slidable within the at least one channel and comprising at least one post sized to engage with at least one of the plurality of post receivers. The mounting clamp may comprise a rotatable threaded coupling extending through the mounting clamp, a threaded washer threadedly coupled to the threaded coupling and configured to clamp lips of the at least one channel between a bottom surface of the mounting clamp and the threaded coupling when the mounting clamp is in a locked position, and engage the lips to prevent separation of the mounting clamp from the track when the mounting clamp is in a slidable unlocked position and the at least one post is removed from the at least one of the plurality of post receivers, and one or more guides extending from the bottom surface of the mounting clamp, the one or more guides positioned to fit between the lips of the at least one channel. The mounting shoulder may comprise a plurality of reentrant openings each positioned to allow one of the plurality of massage fingers to pass through the reentrant opening when the massage apparatus is inserted through the mounting shoulder. The mounting body may comprise a semi-spherical mounting body that forms a mounting chamber proximate the mounting shoulder, the semi-spherical mounting body comprising a coupling positioned opposite the mounting shoulder. The semi-spherical mounting body may comprise a plurality of mounting finger apertures each positioned to allow one of the plurality of a massage fingers to extend therethrough when the massage apparatus is removably entrapped within the massage shoulder. The mounting body may comprise a substantially planar mounting plate and the inner boundary of the mounting shoulder may define an opening extending through the mounting plate.

A third aspect of a massage device mounting system comprises a mounting ring, at least one handle coupled to the mounting ring, and a massage apparatus. The mounting ring comprises a massage apparatus mounting shoulder. The massage apparatus comprises an array of flexible massage fingers positioned to removably entrap the mounting shoulder between at least a first plurality of massage fingers of the array of flexible massage fingers and a second plurality of massage fingers of the array of flexible massage fingers. Each massage finger of the array of flexible massage fingers comprises a center axis central to an outward tip of the massage finger and extending to a center of the massage apparatus. Each center axis is positioned to correspond to a different vertex of a pentakis dodecahedron having the same center as the massage apparatus.

In particular implementations and embodiments, the massage device mounting system may comprise one or more of the following. The at least one handle may comprise two handles coupled to opposing sides of the mounting ring. The at least one handle may comprise a J-shaped element comprising a first end coupled to the mounting ring and a terminating end opposite the first end. The J-shaped element further may comprise a hook on the terminating end and a reentrant opening positioned between the terminating end and the first end. The mounting ring may comprise a substantially circular discontinuous ring. The mounting ring may comprise a polygonal discontinuous ring.

A fourth aspect of a massage device mounting system may comprise at least one mounting body, at least one mounting track, and at least one mounting clamp. The at least one mounting body comprises a mounting base, the mounting base comprising a plurality of post receivers. The at least one mounting track comprises at least one channel. The at least one mounting clamp comprises at least one post sized to fit within at least one of the plurality of post receivers, a rotatable threaded coupling extending through the mounting clamp, a threaded washer threadedly coupled to the threaded coupling and configured to clamp lips of the at least one channel between a bottom surface of the mounting clamp and the threaded coupling when the mounting clamp is in a locked position and the at least one post is within the at least one of the plurality of post receivers, and engage the lips to prevent separation of the mounting clamp from the track when the mounting clamp is in a slidable unlocked position, and one or more guides extending from the bottom surface of the mounting clamp, the one or more guides positioned to fit between the lips of the at least one channel.

In particular implementations and embodiments, the massage device mounting system may comprise one or more of the following. The at least one mounting body may comprise two mounting bodies, each mounting body comprising a slot opposite the mounting base. The at least one mounting track may comprise two mounting tracks each comprising one or more channels. The at least one mounting clamp may comprise at least two mounting clamps. A cylindrical shaft and two opposing bar ends, each bar end configured to mount to the slot of a different mounting body of the two mounting bodies. The mounting body may comprise a cylindrical mounting body extending from the base to a massage apparatus mounting shoulder opposite the base.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶ 6. Thus, the use of the words "function," "means" or "step" in the Detailed Description or Description of the Drawings or claims is not intended to somehow indicate a desire to invoke the special provisions of 35 U.S.C. §112, ¶ 6, to define the invention. To the contrary, if the provisions of 35 U.S.C. §112, ¶ 6 are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶ 6. Moreover, even if the provisions of 35 U.S.C. §112, ¶ 6 are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The disclosure will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended massage apparatuses and/or assembly procedures for massage apparatuses will become apparent for use with implementations of massage apparatuses from this disclosure. Accordingly, for example, although particular massage apparatuses are disclosed, such massage apparatuses and implementing components may comprise any shape, size, style, type, model, version, measurement, concentration, material, quantity, and/or the like as is known in the art for such massage apparatuses and implementing components, consistent with the intended operation of massage apparatuses.

Figure 1:
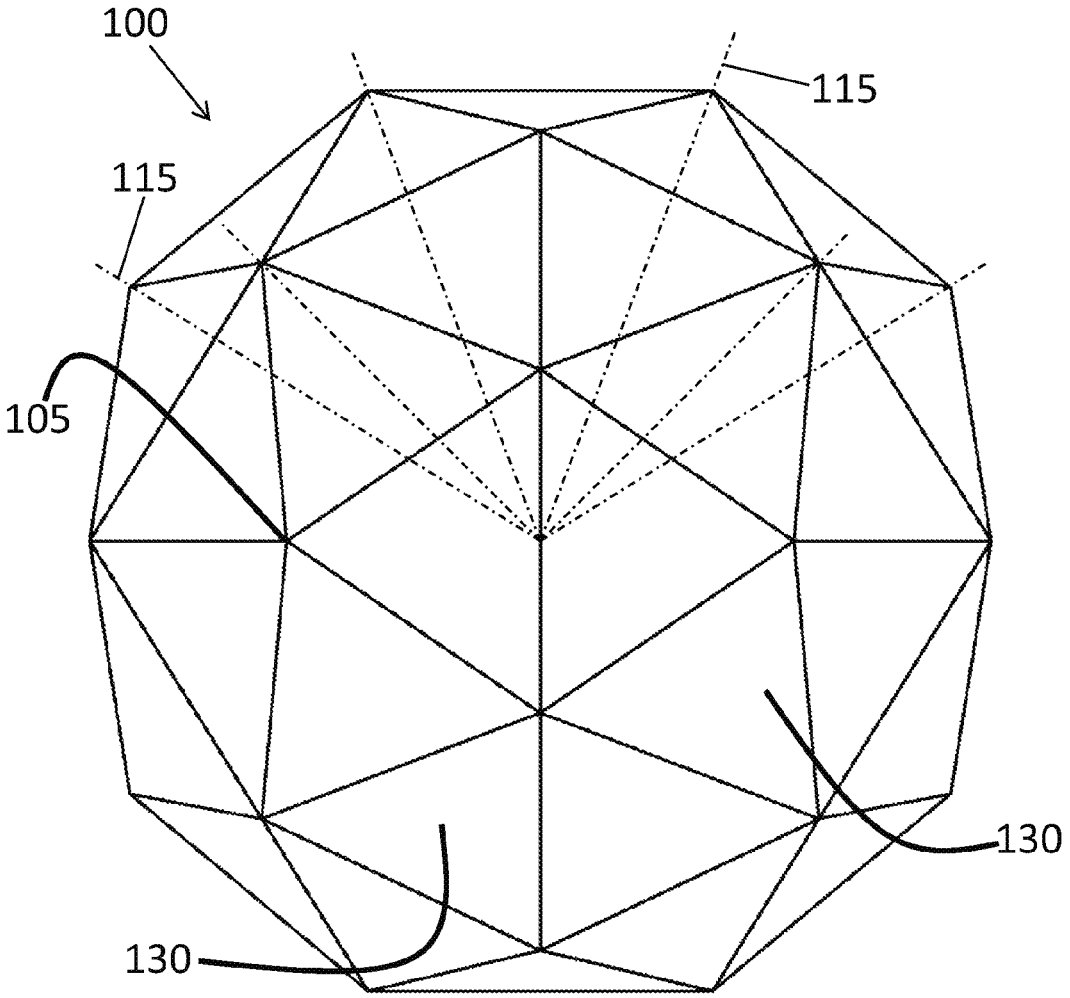
FIG. 1 is a front view of a pentakis dodecahedron.

Various implementations of massage apparatuses are disclosed herein. Some implementations use a variety of a platonic and a non-platonic three-dimensional geometric polyhedron as a basis for configuration of massage fingers on the massage apparatus. Such polyhedron figures may include, but are not limited to tetrahedrons, octahedrons, cubes, icosahedrons, dodecahedrons, pentakis dodecahedrons, pentagonal icositetrahedrons, or triakis icosahedrons. Each polyhedron comprises a corresponding number of vertices and faces, as well as a specific dihedral angle. A dihedral or torsion angle is the angle between two planes. Accordingly, a tetrahedron comprises four vertices and a dihedral angle of 70.53 degrees. An octahedron comprises six vertices and a dihedral angle of 109.47 degrees. A cube comprises eight vertices and a dihedral angle of 90.00 degrees. An icosahedron comprises twelve vertices and a dihedral angle of 138.19 degrees. A dodecahedron comprises twenty vertices and a dihedral angle of 116.57 degrees. A pentagonal icositetrahedron comprises 38 vertices and a dihedral angle of 136.33. A triakis icosahedron comprises 32 vertices and a dihedral angle of 160.61. A pentakis dodecahedron 100 is illustrated in FIG. 1, and comprises thirty-two vertices 105, sixty faces 130, and a dihedral angle of 156.72 degrees. FIG. 1 also illustrates a vertex axis 115 that extends from the three-dimensional center of the pentakis dodecahedron through a vertex 105.

Various implementations of a massage ball may utilize any three-dimensional polyhedron listed herein or otherwise in a configuration of a massage apparatus. As shall be described in greater detail with respect to FIGS. 2-6, a massage apparatus may comprise an array of massage fingers or protrusions, the centers of which align with vertex axes that extend from a center of a theoretical three-dimensional figure through vertices of the theoretical three-dimensional figures.

For effective use, massage fingers or protrusions on a massage apparatus must be spaced far enough apart to stimulate individual points within soft tissue of a person on whom the massage apparatus is being utilized. On the other hand, effective use of a massage apparatus is greatly enhanced when the massage fingers or protrusions are spaced close enough and relatively uniformly across the massage apparatus to enable both easy and predictable translation/rolling of the massage apparatus between the user's body and the opposing surface.

Accordingly, specific implementations of a massage apparatus may utilize a polyhedron comprising at least twenty vertices and not more than forty vertices as a base geometric shape for the massage apparatus. At least twenty massage fingers or protrusions spaced at substantially equal spacing across a massage apparatus provides a massage apparatus that is advantageous to prior art because the massage fingers or protrusions are far enough apart to allow for proper stimulation of individual points within soft tissue of the receiver, while close enough and uniformly spaced to enable easy and predictable translation/rolling of the massage apparatus.

Implementations utilizing a platonic polyhedron, such as a dodecahedron, as a base for the massage apparatus comprise massage fingers at an equal distance from the nearest massage fingers. Particular therapeutic advantage has been found in implementations using a non-platonic polyhedron, such as a pentakis dodecahedron, as a base for a massage apparatus, the massage fingers may be at substantially or nearly equal spacing from the nearest massage fingers. For example, in a massage apparatus utilizing a pentakis dodecahedron, the ratio of distances between nearest and furthest adjacent vertex axes or massage fingers is approximately 0.9:1:0.

Figure 9:
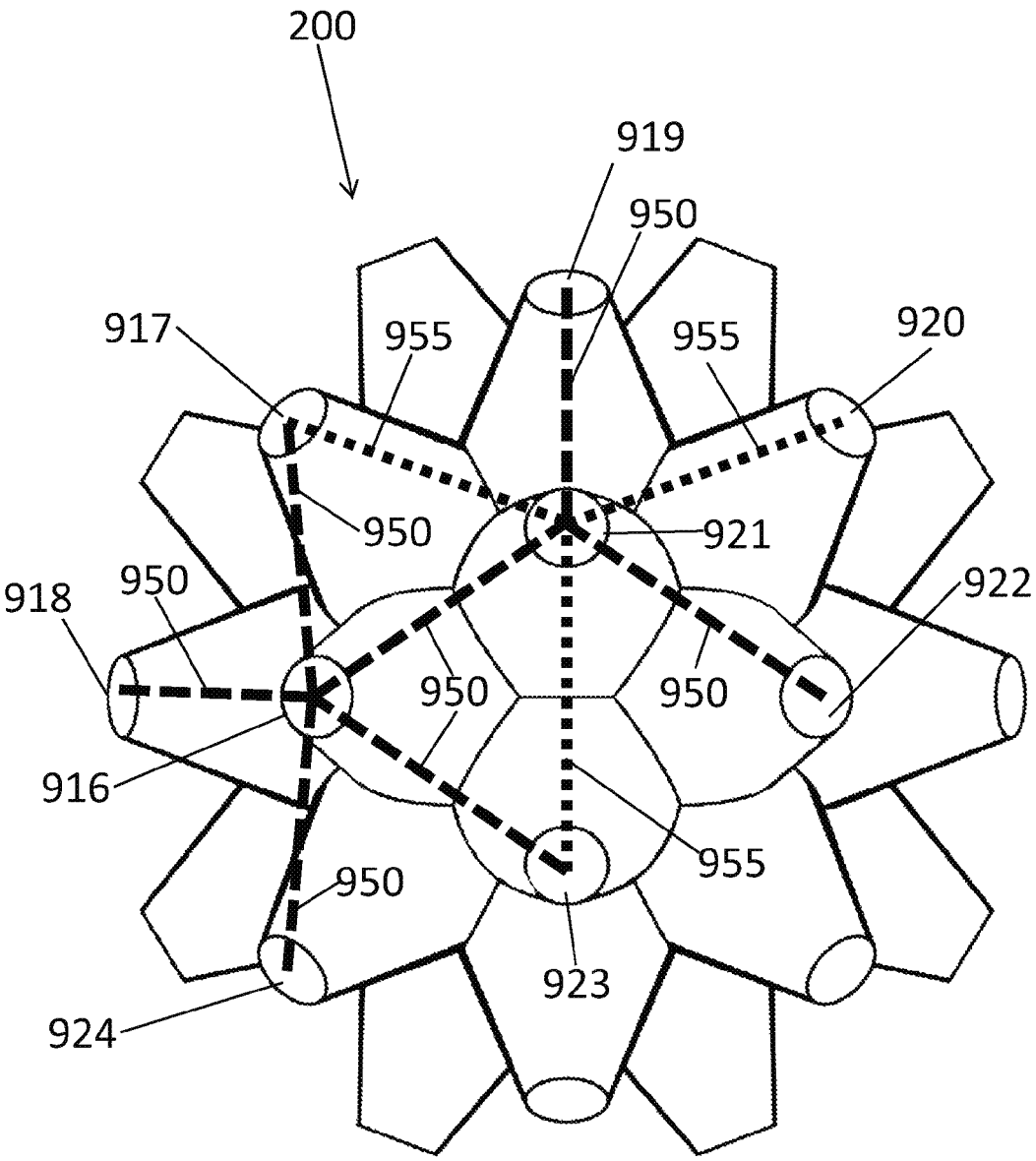
FIG. 9 is a perspective view of a massage apparatus illustrating the respective distances between massage fingers.

In a pentakis dodecahedron, twenty vertices of the thirty-two vertices are each surrounded by six vertices, while the remaining twelve vertices are surrounded by five vertices. As illustrated in FIG. 9, for a massage finger 916 surrounded by only five massage fingers 917, 918, 921, 923, 924, the first or lesser distance 950 between the central massage finger 916 and each of the five surrounding massages fingers 917, 918, 921, 923, 924 is an equal distance 950. A massage finger 921 surrounded by six massage fingers 916, 917, 919, 920, 922, 923 comprises three fingers 917, 920, 923 at a second or greater distance 955 than the first or lesser distance 950 between the massage finger 921 and the remaining three massage fingers 916, 919, 922. In an implementation, the relative ratio of the lesser distance 950 to the greater distance 955 is approximately 0.9:1.0. Each of the twenty vertices or massage fingers surrounded by only five vertices or massage fingers may comprise a pattern similar to that illustrated in FIG. 9, specifically each of the five surrounding vertices or massage fingers are at the same distance from the central massage finger. Likewise, each of the twelve vertices or massage fingers surrounded by six vertices or massage fingers may comprise a pattern similar to that illustrated in FIG. 9. Specifically, the three lesser distanced and three greater distanced massage fingers may alternate in placement around the central massage finger. The precise distance ratio between the lesser distance 950 and the greater distance 955 may be calculated with the formula: $18*(2*\sqrt{5}-1)/57*(\sqrt{5}-1)=0.887058$, or approximately 0.9:1.0. The same spacing configuration between massage fingers of FIG. 9 may be applied to any implementation disclosed herein, and is not limited to the implementation illustrated in FIG. 9.

Figure 2:
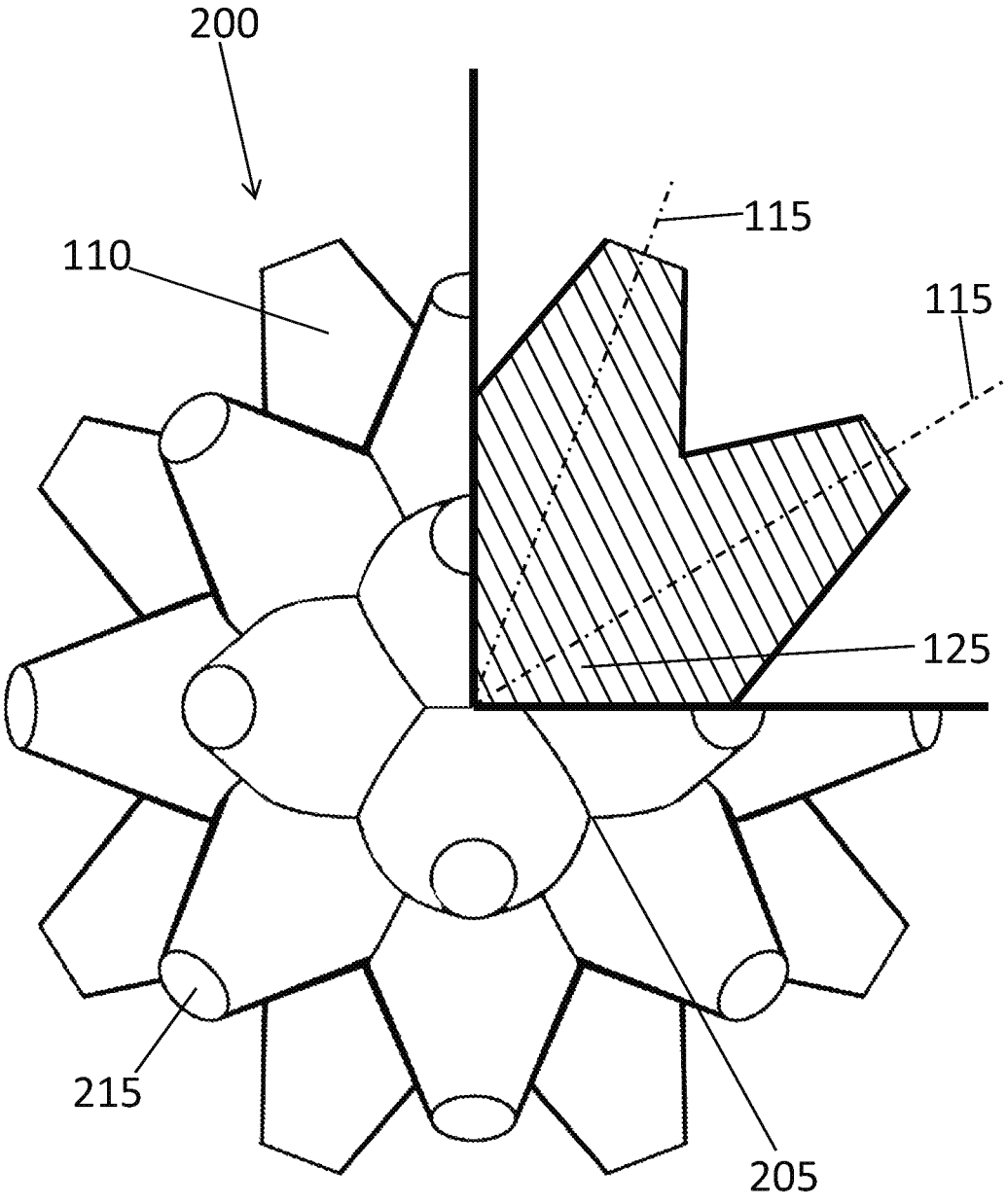
FIG. 2 is a partial cross-sectioned front view of first implementation of a massage apparatus.

Referring now to FIG. 2, a partial cross-section view of an implementation of a massage apparatus 200 is illustrated. According to a particular implementation, a massage apparatus 200 may comprise an array of merged massage fingers 110 around a central massage apparatus body 125. The massage fingers 110 of massage apparatus 200 are substantially conical in shape with a flat outward tip 215 and an inward base 205. As shall be shown in other implementations, the massage fingers 110 may comprise any shape and any tip and/or base configuration. In FIG. 2, the inward bases 205 of the massage fingers 110 intersect to form a central body 125. In other implementations, the massage fingers may be coupled or configured to a body 125 in any manner.

The implementation of FIG. 2 utilizes a theoretical pentakis dodecahedron base and comprises thirty-two massage fingers 110 spaced to correspond with the spacing of the thirty-two vertices of a theoretical pentakis dodecahedron base shape, whether the actual shape of the base is a pentakis dodecahedron, a sphere, or any other shape. The massage fingers 110 may be aligned such that a center axis 115 central to the outward flat tip 215 and the inward base 205 of the massage apparatus 200 extends from a center of the body 125 through the center of the inward base 205 and outward tip 215. For relative positioning of the massage fingers 110, the center of the body 125 is aligned with a center of the theoretical polyhedron, specifically in this implementation the center of the pentakis dodecahedron for aligning of the massage fingers 110 with the locations of where the vertices of the pentakis dodecahedron would exist. The center axes 115 of the massage apparatus 200 is positioned so as to correspond with the vertex axes 115 of the shape illustrated in FIG. 1.

Other implementations similar to massage apparatus 200 may comprise any number of massage fingers 110 aligned positioned to correspond with the vertices of any type of polyhedron. For example, an implementation may comprise a dodecahedron as a base polyhedron shape for a massage apparatus. Such an implementation may then comprise twenty massage fingers, each equally spaced from the three nearest massage fingers. Furthermore, the center axes of the twenty massage fingers 110 would align with the locations of the twenty vertex axes of a dodecahedron extending from a center of the dodecahedron to each of the twenty vertices.

The massage apparatus 200 and other massage apparatuses disclosed herein may comprise a variety of sizes and hardness measurements. Particular implementations may comprise a massage apparatus with a diameter of between two and six inches from the outer tip of a massage finger 110 to the outer tip of a massage finger on an opposing side of the massage apparatus. While implementations may comprise a variety of materials, such as but not limited to rubbers, foams, plastics, inflatables, and the like, in a particular implementation, the massage apparatus comprises a thermoplastic elastomer or natural rubber. In particular implementations, the hardness ranges from forty to eighty Shore A durometers. Other sizes and hardnesses may be used depending upon the particular size and weight of the user, the particular area of the body being treated, and the particular massage therapy being administered.

Figure 3:
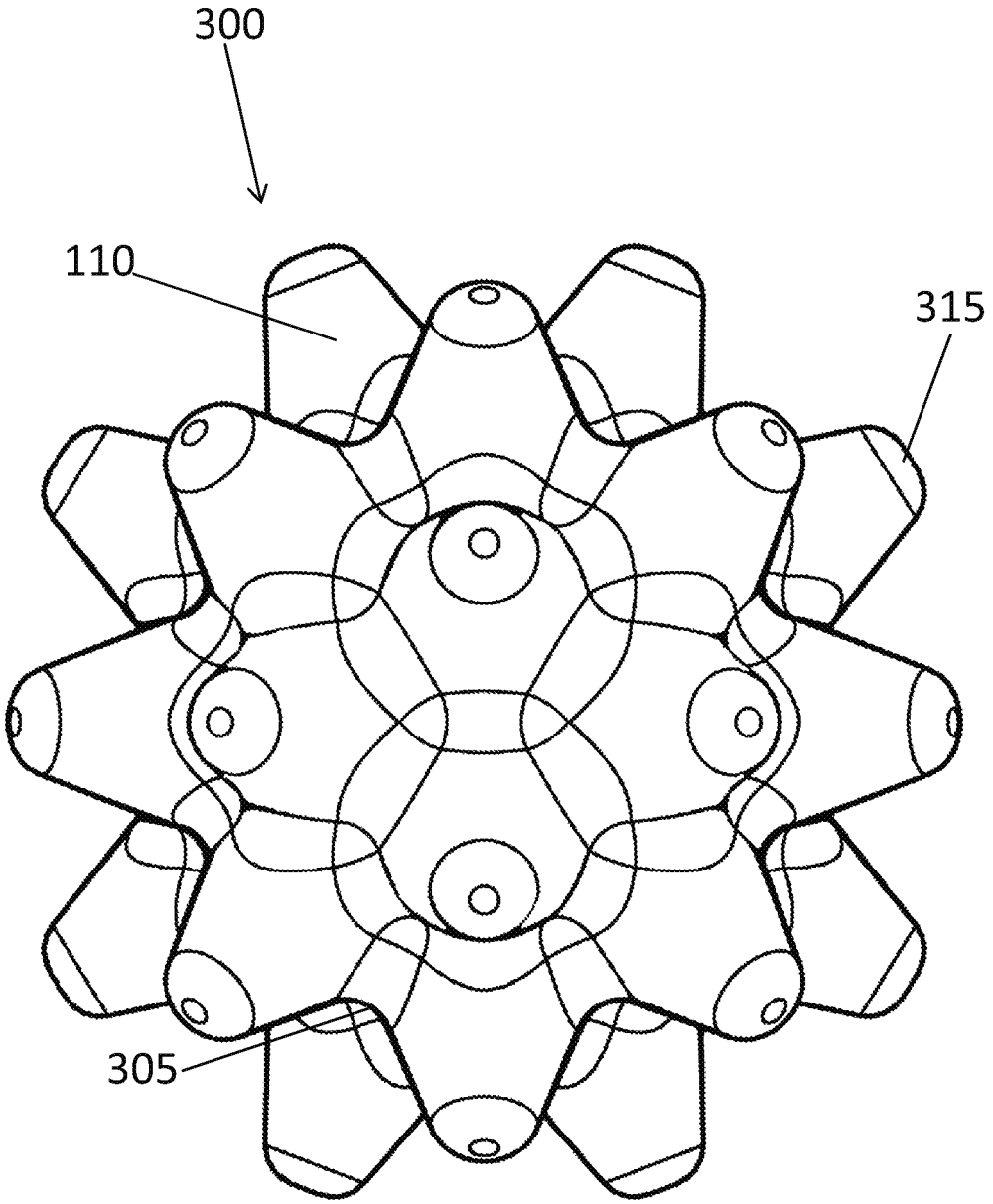
FIG. 3 is a front view of a second implementation of a massage apparatus.

Referring now to FIG. 3, illustrating a massage apparatus 300 comprising a rounded tip 315 on each massage finger 110 and a filleted edge 305 or intersection at the intersection of the inward base of each massage finger 110 with other surrounding massage fingers 110. The plurality of massage fingers 110 on massage apparatus 300 may be arranged and spaced based on a theoretical polyhedron as previously described. The massage fingers 110 of FIG. 3 are substantially conical in shape, while massage fingers 110 for this or any other implementation may comprise any shape, such as but not limited to cylindrical, cubical, spherical, diamond shaped, and the like.

In specific implementations, the apex angle of the cone-shaped massage fingers 110 is between twenty and sixty degrees. The height of massage fingers 110 from the rounded tip 315 to the filleted edge 305 is greater than 0.25 inches. Other implementations may comprise any angle and any massage finger 110 height.

Figure 4:
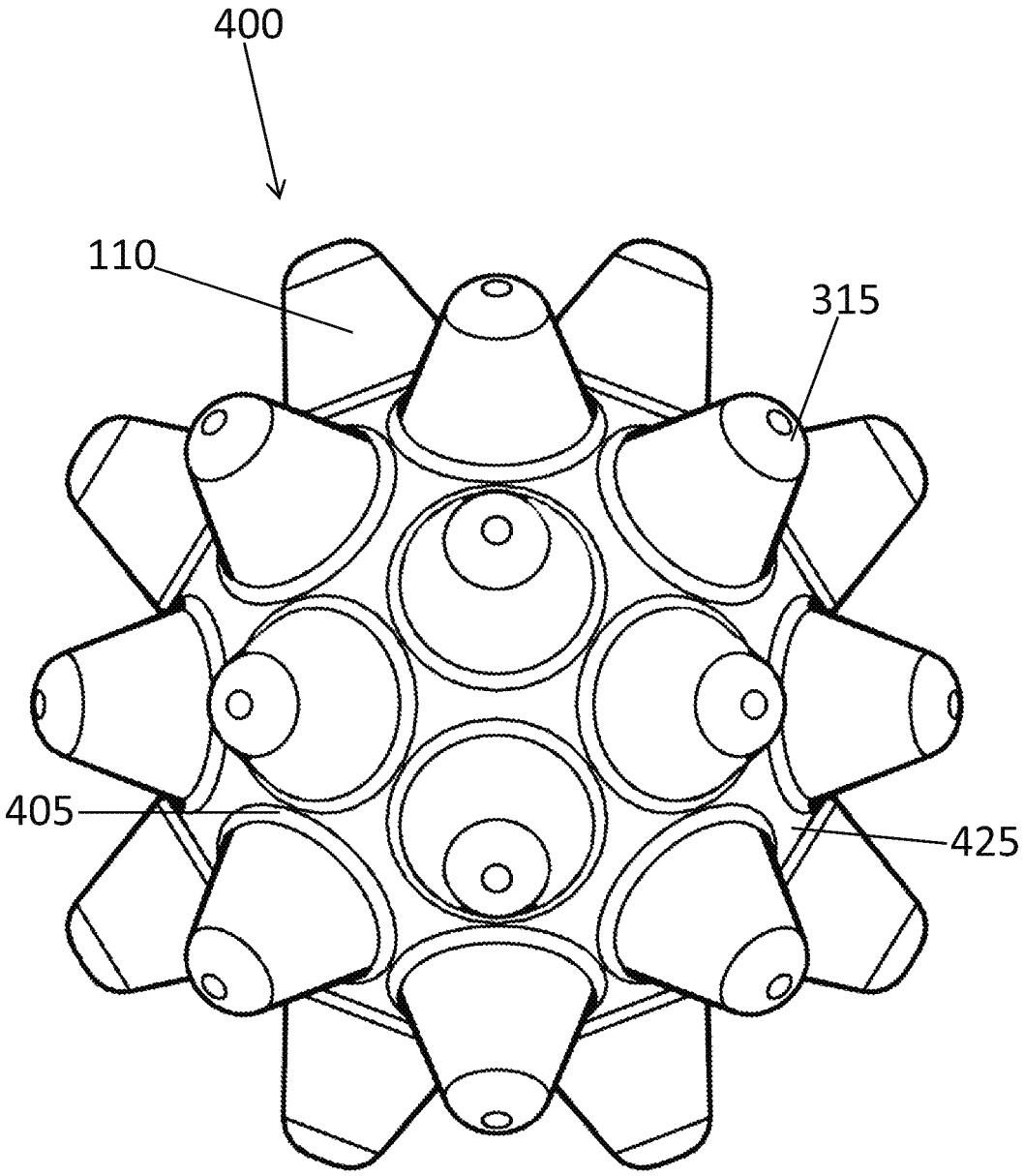
FIG. 4 is a front view of a third implementation of a massage apparatus.

Referring now to FIG. 4, illustrating a massage apparatus 400 comprising a spherical body 425. The plurality of massage fingers 110 on massage apparatus 400 may be arranged and spaced based on a theoretical polyhedron as previously described, so as to correspond with the locations of the vertices of a particular polyhedron. The intersection of the massage fingers 110 and the spherical body 425 may comprise a filleted intersection 405, or any type of intersecting planes.

Figure 5:
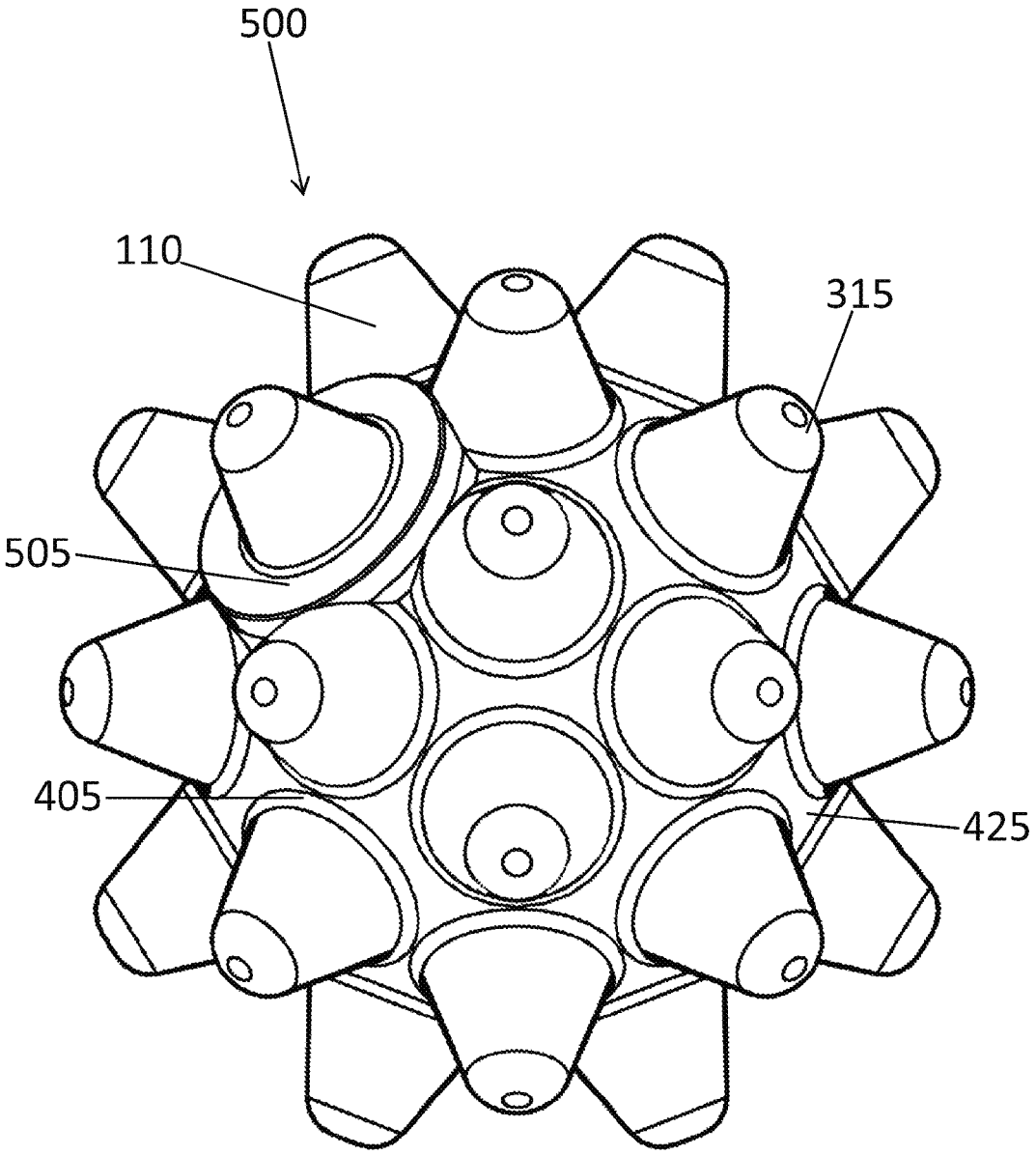
FIG. 5 is a front view of a fourth implementation of a massage apparatus.

Referring now to FIG. 5, illustrating a massage apparatus 500 further comprising a boss 505 at the base of at least one massage finger 110. Other implementations may comprise a boss 505 at the base of any number of the massage fingers 110. The plurality of massage fingers 110 on massage apparatus 500 may be arranged and spaced based on a theoretical polyhedron as previously described, so as to correspond with the vertices a particular polyhedron. As illustrated in FIG. 5, the boss 505 comprises a cylindrical configuration that surrounds or circumnavigates at least a portion of the inward base of the massage finger 110. In other implementations, the boss 505 may comprise any shape or finishing edge around the massage finger 110 that allows the massage finger 110 to locate onto or within another opening of a separate massage apparatus, thus locating or joining the massage apparatus 500 with another massage apparatus. For example, the particular massage finger 110 comprising the boss 505 at the base may be sized, shaped, or otherwise configured to fit within a substantially conical hole, void, or depression on a separated massage apparatus (shown in greater detail in FIG. 6).

The boss 505 may further comprise any type of coupling element, such as but not limited to magnets, adhesive, screw threads, pins, and the like. In an embodiment, a magnet may be place under the surface of the boss 505 such that the magnet does not decrease performance of the massage apparatus 500, but may nonetheless still be attracted to metal or an opposite poled magnet. In this and any other implementations discussed herein, the massage fingers 110 may be configured to be removably coupled to the base 125, 425. The removable coupling of a massage finger 110 to the base 125, 425 may work by way of magnets, adhesive, screw threading, pins, or any other elements for removable coupling. In particular implementations, the boss 505 may simply be used as a marking location for marking the massage ball with a product name or manufacturer name. Nevertheless, the inclusion of the boss 505 surrounding a massage finger 110 does not interrupt the placement of the remaining massage fingers 110.

Figure 6:
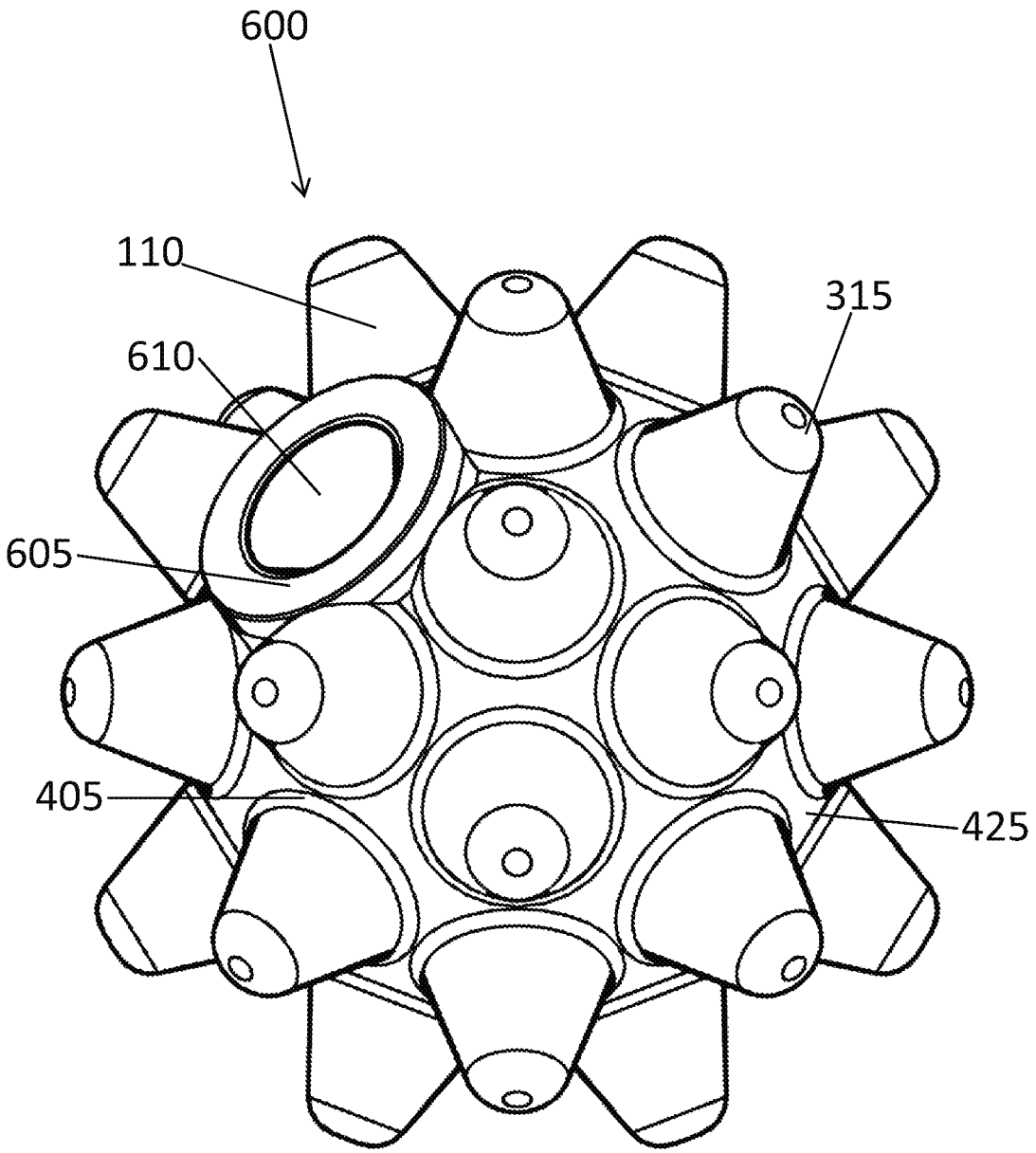
FIG. 6 is a front view of a fifth implementation of a massage apparatus.

Referring now to FIG. 6, illustrating a massage apparatus 600 comprising a recessed receiving element 610 in place of a massage finger 110. Other implementations may comprise any number of recessed receiving elements 610 in place of any number of massage fingers 110. The recessed receiving element 610 may comprise any type of recess, hole, void, channel, through-hole, or depression sized, shaped, or otherwise configured to receive a massage finger 110 from separate massage apparatus, a post or handle from a massage grip, or any other type of connecting apparatus.

The recessed receiving element 610 may be surrounding by a boss 605. As illustrated in FIG. 6, the boss 605 comprises a cylindrical configuration that surrounds or circumnavigates the recessed receiving element 610. In particular implementations, the receiving element 610 extends all the way through the body 425 to form a bore hole so that a handle or shaft can be extended through the massage ball 600 for convenient handling and use of the massage ball. In other implementations, the boss 605 may comprise any shape or finishing edge around the recessed receiving element 610 that allows the recessed receiving element to locate onto or within another opening of a separate massage apparatus, thus locating or joining the massage apparatus 600 with another massage apparatus or connecting apparatus. For example, recessed receiving element 610 may be sized, shaped, or otherwise configured to hold similarly sized, shaped, or otherwise configured protrusion on another massage apparatus or connecting apparatus. In an implementation, the boss 605 may mate with a boss receiver on another massage apparatus or connecting apparatus.

With the exception of the at least one recessed receiving element 610, the plurality of massage fingers 110 on massage apparatus 600 may be arranged and spaced based on a theoretical polyhedron as previously described, so as to correspond with the vertices of a particular polyhedron. For example, in an implementation with massage fingers 110 placed to align with the vertices of a theoretical pentakis dodecahedron, the massage apparatus may comprise thirty or thirty-one massage fingers 110 corresponding to thirty or thirty-one vertices and two or one recessed receiving element 610 corresponding to two or one vertex of the thirty-two vertices of the theoretical pentakis dodecahedron. In a particular implementation, two recessed receiving elements 610 are included on exactly opposite, aligning positions of the massage apparatus 600. In other implementations, regardless of theoretical polyhedron, a recessed receiving element 610 may be aligned with a vertex of the polyhedron in place of a massage finger 110.

Figure 7:
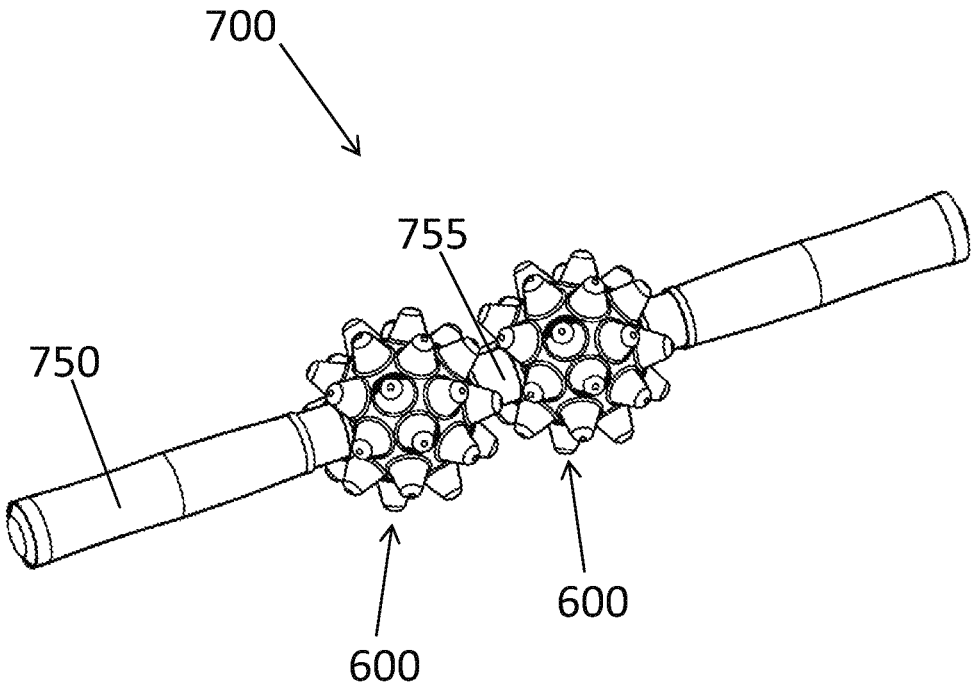
FIG. 7 is a perspective view of a massage apparatus and massage bar.

Referring now to FIG. 7, illustrating a plurality of massage apparatuses 600 coupled to massage bar 750. In a particular implementation, the massage apparatus 600 may be void of two massage fingers 110 on opposing sides of the massage apparatus 600. The recessed receiving elements 610 replacing each of the two voided massage fingers are aligned with two opposing vertex axes 115 of a polyhedron. The recessed receiving elements may be further configured to continue until the two receiving elements 610 meet, thus forming a channel, hole or void that continues through the massage apparatus 600. Such an implementation may be configured to receive a massage bar 750 or rod that extends through the massage apparatus 600. The massage bar 750 may extend through a second massage apparatus or may alternatively connect to a similarly coupled second massage apparatus and bar. A spacer or sleeve 755 may be placed on the massage bar 750 between adjacent massage apparatuses 600.

In various implementations illustrated in FIGS. 7, 10, 13-15, 19-23, and 25, a massage bar 750, 994 may comprise a shaft 753 (see FIG. 20) configured or otherwise sized to fit through the bore hole 758 on implementations of massage apparatuses. The shaft 753 may comprise a variety of materials, such as but not limited to plastics, rubbers, metals, wood, and the like. In a particular implementation, the shaft 753 comprises a fiberglass shaft.

The massage bar 750 may further comprise a handle 752, 995 on each end of the massage bar 750. In particular implementations, the massage bar 750 may further comprise at least one sleeve 755 about the shaft used as a spacer. For example, a sleeve 755 may be placed between the two massage apparatuses 600, and between each massage apparatus 600 and the handles 752, 995. The sleeve may be comprised of a variety of materials, such as but not limited to PVC, plastic, rubber, metal, and the like.

The massage bar may further comprise a flange bearing 756 at the boss 605 of massage apparatus 600, or even without the boss in other implementations. The flange bearing 756 may be inserted into an end of the bore hole 758 before or as the shaft 753 is inserted through the bore hole 758. The flange bearing 756 may assist in the rotating efficiency of the massage apparatus 600 about the shaft 753, and may be comprised of a variety of materials such as but not limited to nylon, plastic, rubber, metal, and the like.

In an alternative implementation, the massage bar 750 may comprise a tip configured to mate with the receiving element 610 of the massage apparatus 600 and removably couple the massage bar 750 to the massage apparatus 600. Two massage apparatuses 600 may be removably coupled together with a spacer 755 adapted to couple to each of two massage apparatuses 600, one at either end. The spacer 755 may either fit within recessed receiving elements 610 of the massage apparatus 600, or hold massage fingers 110 of the massage apparatus 600. Bosses 505, 605 may assist in coupling the massage apparatus 500, 600 to the spacer 755 and/or the massage bar 750.

Coupling of various implementations of massage apparatuses 600 to the massage bar 750 comprises a pivotal mounting that allows the massage apparatus 600 to roll and rotate over a body or other surface while the massage bar 750 handles do not rotate. Rotation of the massage apparatus(es) 600 is typically about a center axis of the massage bar 750. Configuration of the rolling massage apparatus(es) coupled to the massage bar 750 allows for effective use of the massage apparatus(es) 600 over a greater amount of body area. For example, a user of the combined massage bar 750 and massage apparatus(es) 600 may reach and massage other body areas for self massage, or a therapist or massage assistant may use the bar to assist in providing a deeper massage in particular situations.

Figure 8:
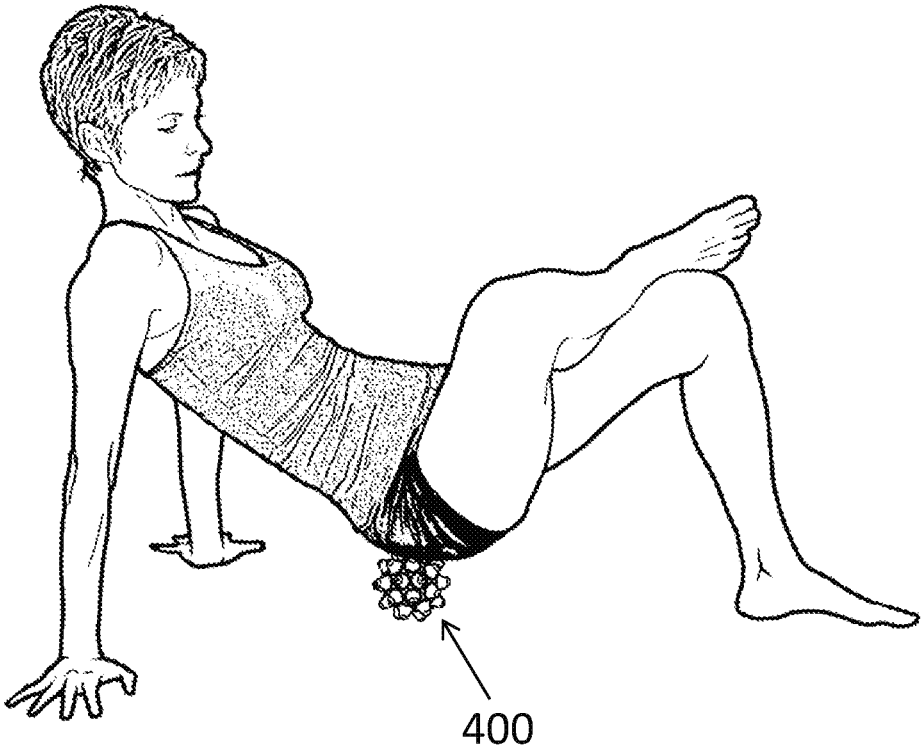
FIG. 8 is a perspective view of an exemplary use of a massage apparatus.

Referring now to FIG. 8, illustrating an exemplary use of a massage apparatus 400. Although massage apparatus 400 is illustrated in FIG. 8, any massage apparatus disclosed herein may be utilized in similar fashion. The massage apparatus 400 may be placed between a user and a surface, such as a floor, wall, ground, door, window, etc. The massage apparatus 400 may be further used by pressing the massage apparatus 400 against a user's body with the user's own hands or the hands of another individual. Due to the spacing, configuration, and/or number of massage fingers 110 on the massage apparatus 400, the massage apparatus 400 effectively, consistently and evenly rolls between the user and the surface, by evenly moving across the floor due to the regular and consistent spacing of the massage fingers 110. The spacing, configuration, and number of massage fingers 110 further allows for individual massage fingers 110 to effectively reach the soft tissue of the user.

Figure 10:
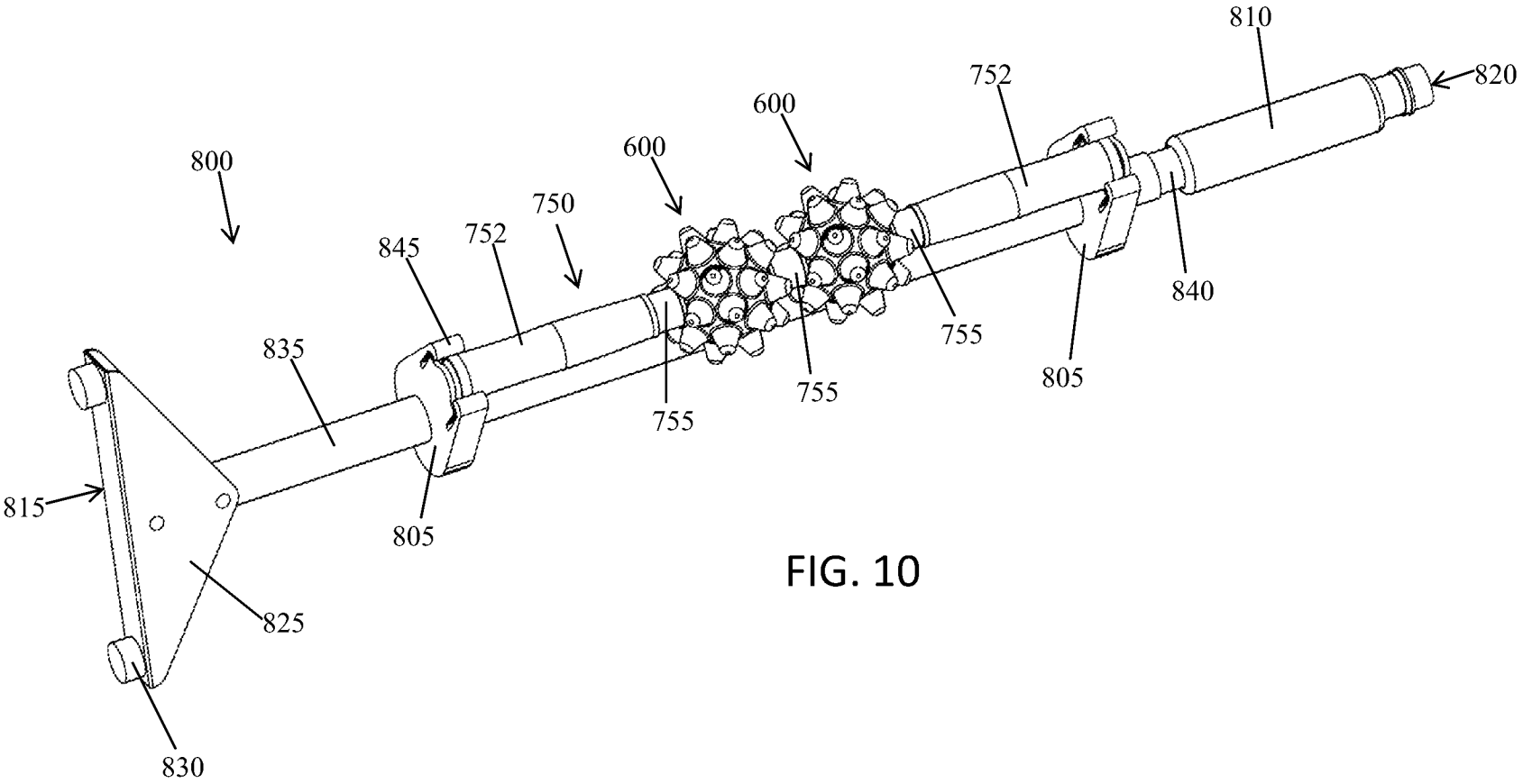
FIG. 10 is a perspective view of massage apparatuses, a massage bar, and a telescoping doorway mount.

Referring now to FIG. 10, illustrating a massage apparatus device or system for pivotally mounting a massage apparatus 600. Although massage apparatus 600 is illustrated in FIGS. 7, 10, 13-15, 19-23, and 25, it will be understood that modifications of any of the massage apparatuses disclosed herein allow for similar use or mounting. Similarly, although massage bar 750 is illustrated and described in use with FIGS. 10 and 13, massage bar 994 and other massage bars are also contemplated for use in the telescoping doorway mount 800. In FIG. 10, massage bar 750 is mounted on a telescoping doorway mount 800. In various implementations, the doorway mount 800 may comprise a first end 815, a second end 820 opposite the first end 815, an outer frame member 835, and inner frame member 840, and at least two mounting elements 805. The massage bar 750 may be mounted within or to the telescoping doorway mount 800 by coupling and/or mounting the handles 752 or shaft 753 to the mounting elements 805.

Figure 11:
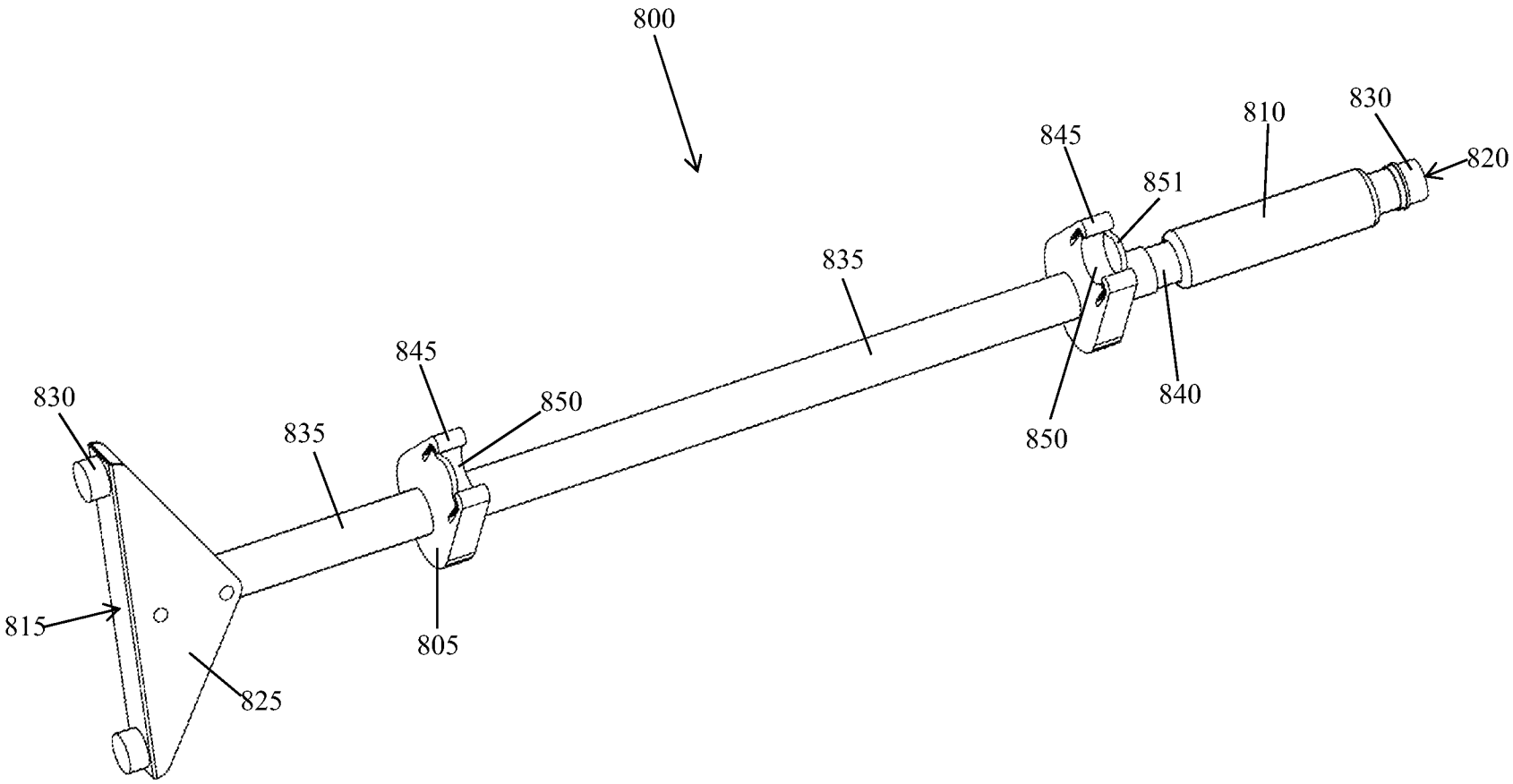
FIG. 11 is a perspective view of a telescoping doorway mount for use with a massage bar.

Referring now to FIG. 11, the mounting elements 805 may comprise a curved groove 850, slot, channel or reentrant opening configured to allow the massage bar 750 to rest within the mounting elements 805. The mounting elements 805 may be pivotally or fixedly coupled to the outer frame member 835 or the inner frame member 840. In a particular implementation, the mounting elements 805 are coupled to the outer frame member 835, and the outer frame member 835 passes through at least a portion of each mounting element 805.

Implementations of the mounting elements 805 may further comprise biased elements 845 or clips that assist in removably coupling or mounting the massage bar 750 to the mounting elements 805. Once the massage bar 750 is within the curved groove 850, the biased elements or clips act to hold the massage bar 750 within the curved groove 850. An implementation of the mounting element 805 may further comprise end covers 851 to hold the massage bar 750 between the mounting elements 805. Another implementation of the mounting element 805 may comprise ribs configured to fit within the slots 997 of massage bar 994.

An implementation of the telescoping doorway mount 800 may further comprise a rectangular base on the first end 815.

Two walls 825 may be coupled to rectangular base and extend toward the second end 820. In other implementations, first end 815 may comprise any shape of base. Elongating the base, in the shape of a rectangle, ellipse, etc., provides additional support and stability to the telescoping doorway mount 800 when in use.

Additional support and stability may be provided by two walls 825 coupled to the first side 815 and extending toward the second side 820. In the implementation shown in FIGS. 10-13, the walls comprise triangular walls 825, although other shapes and configurations may be utilized in other implementations. The outer frame member 835 is typically located between the two walls 825, and may be coupled to the first end 815, the two walls 825, or both the first end 815 and the two walls 825. Various implementations for the telescoping doorway mount 800 may comprise at least one pad 830 on each side 815, 820 of the telescoping doorway mount 800, and a hand grip 810 on the inner frame member 810.

Figure 12:
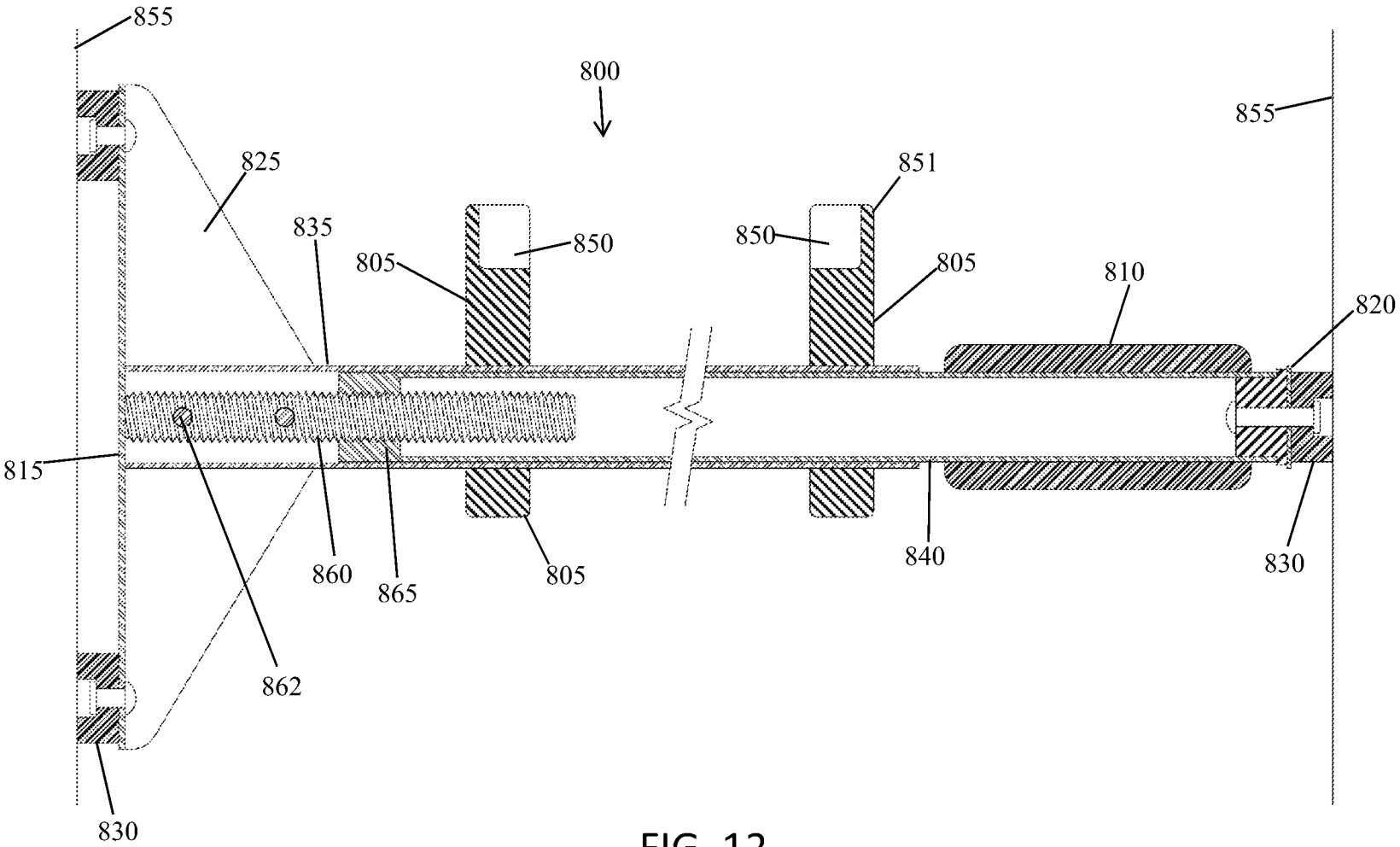
FIG. 12 is a partial cross sectioned side view of a telescoping doorway mount for use with a massage bar.

FIG. 12 illustrates a cross sectioned view of a telescoping doorway mount 800 coupled between two walls 855. In an implementation, the telescoping doorway mount 800 may comprise a male screw 860 coupled to either the first end 815 or between the two walls 825 and extending from the first end 815 towards the second end 820. Set screws 862 are utilized in the implementation of FIG. 12 to couple the male screw 860 to the telescoping doorway mount 800 between the two walls 825. In other implementations, whether or not the walls 825 are present, the male screw 860 may be coupled to the first end 815 in a variety of mechanisms know in the art, such as but not limited to welding, bolting, screws, adhesives, and the like.

An implementation of the telescoping doorway mount 800 may further comprise an inner frame member 840 that fits at least partially within the outer frame member 835 and is coupled to or extends from the second end 820. The inner frame member 840 may further comprise a female threaded end 865 located opposite the second end 820 and configured to couple to the male screw 860. The female threaded end 865 and the male screw 860 function in conjunction with each other to change the length of the telescoping doorway mount 800 such that the telescoping doorway mount 800 may be configured to fit within a variety of sized doorways.

For example, by rotating the inner frame member 840 a first direction, the female threaded end 865 is also rotated about the male screw 860 a first direction, which subsequently causes the female threaded end to move close to the first end 815 and shortens the telescoping doorway mount 800. By rotating the inner frame member 840 a second direction, the female threaded end 865 is rotated about the male screw 860 a second direction, which subsequently causes the female threaded end 865 to move further from the first end 815 and lengthens the telescoping doorway mount 800. In other implementations, the first and second frame members may be extended and shortened using mechanisms other than threaded connections. For example, a ratcheting extension, such as that disclosed in U.S. Pat. No. 5,947,666 to Huang titled "Cargo positioning device with quick retraction and reliable retaining function," the disclosure of which is hereby incorporated herein by reference, may alternatively be substituted for the rotating components of the embodiment of FIG. 12. The telescoping functionality is not limited to the specific mechanisms shown and described for enabling the functionality, which are provided as non-limiting examples. Other mechanisms known in the art are also contemplated.

Figure 13:
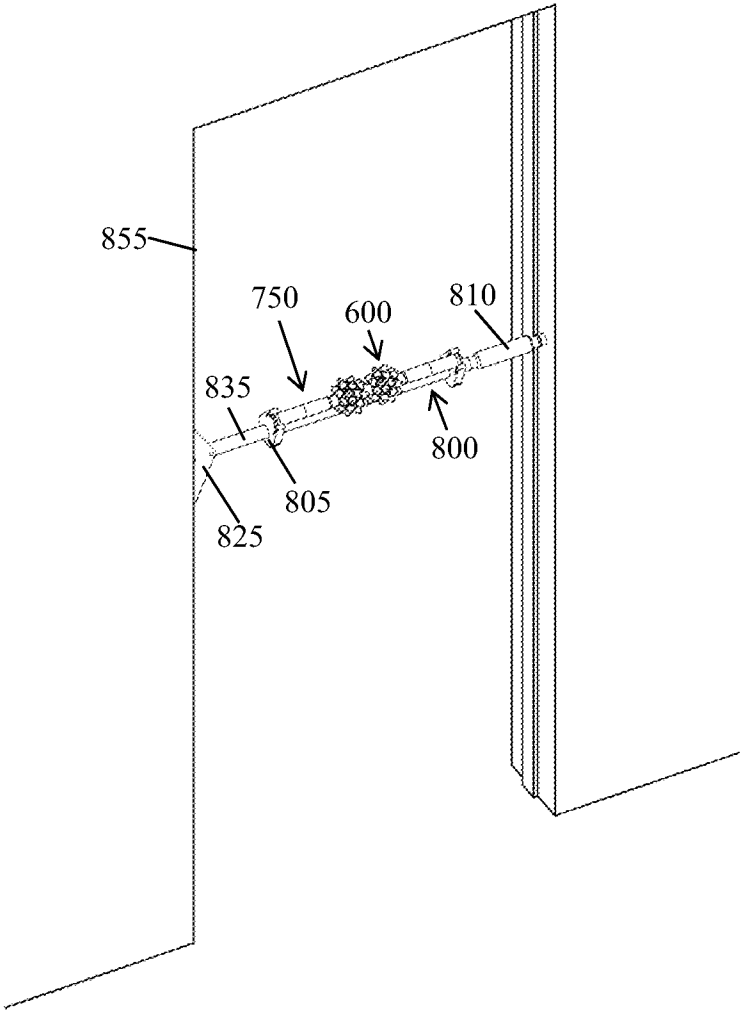
FIG. 13 is a perspective view of an exemplary mounting of a telescoping doorway mount, a massage bar, and massage apparatuses within a doorway.

FIG. 13 illustrates an exemplary use of the massage bar 750 mounted to the telescoping doorway mount 800. By mounting telescoping doorway mount 800 within a frame 855 and mounting the massage bar 750 on the telescoping doorway mount 800, functionality of massage apparatuses 600 is enhanced. For example, the structure and assembly of the massage bar 750 allow the massage apparatuses 600 to rotate about an axis formed by the shaft 753 of the massage bar. When mounted properly on the telescoping doorway mount 800 and when the doorway mount 800 is mounted within a doorway 855, a user may lean his or her body against the massage apparatus and move up and down. This allows a user, without the assistance of others, to utilize the massage apparatus on his/her back in areas previously unreachable without the assistance of others.

Figure 14:
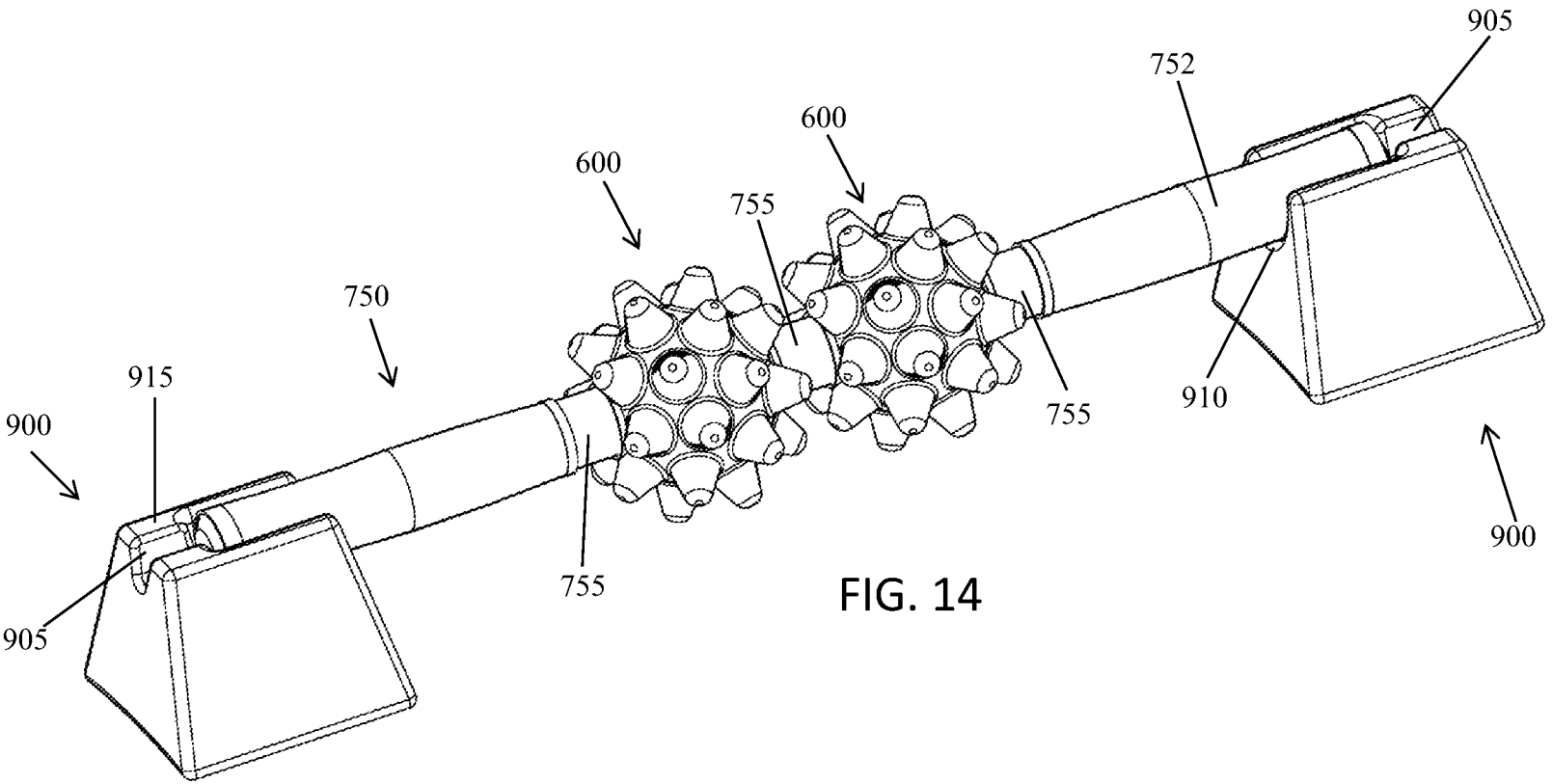
FIG. 14 is a perspective view of a massage bar mounted on a first implementation of surface mounts.
Figure 15:
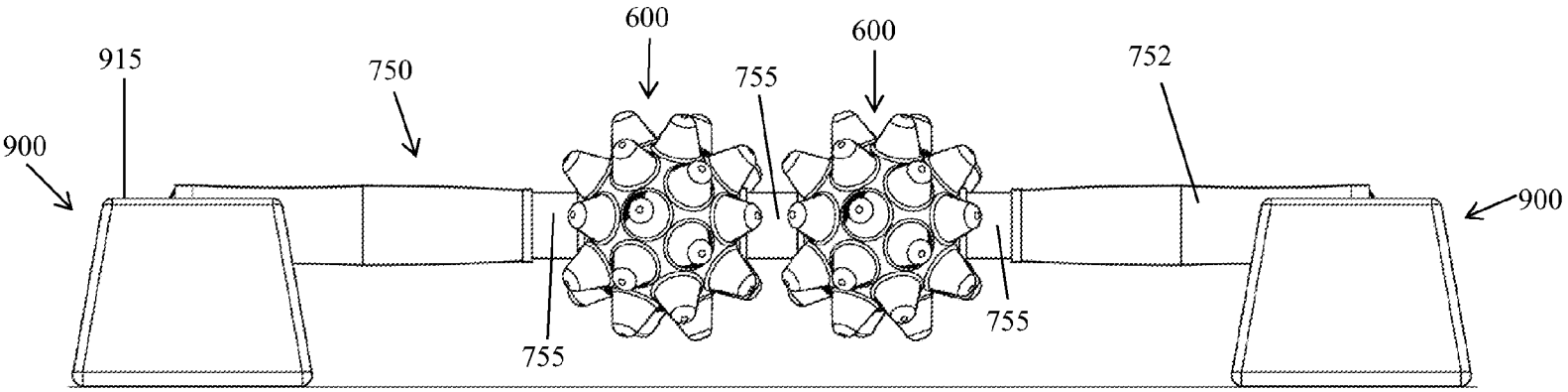
FIG. 15 is a side view of a massage bar mounted on a first implementation of surface mounts.
Figure 16:
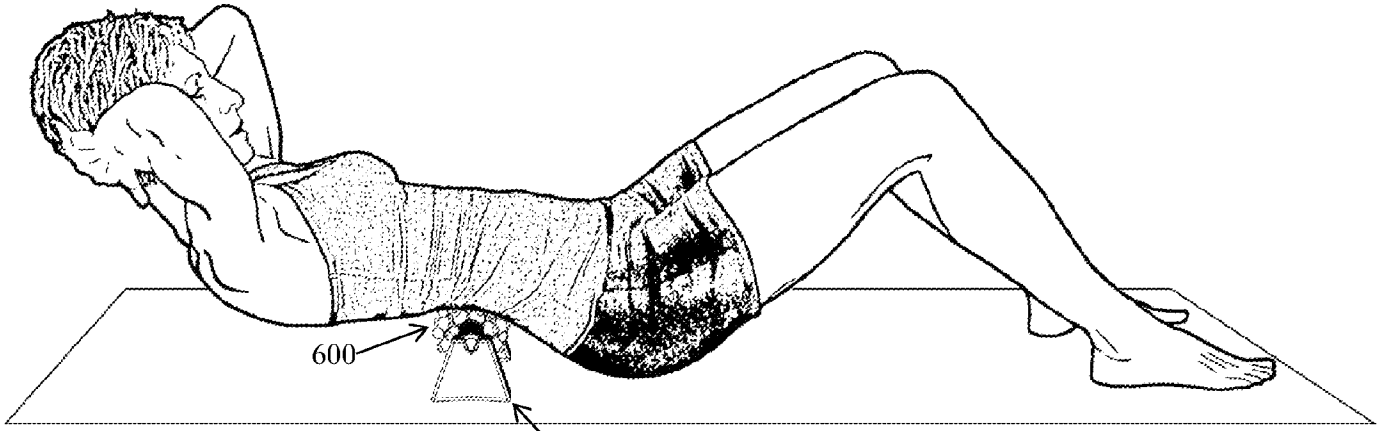
FIG. 16 is a perspective view of an exemplary use of a massage apparatus mounted on a first implementation of surface mounts.

Various implementations of massage bars 750, 994 may also be mounted just above a surface, such as the floor, on surface mounts 900, 951. FIGS. 14-16 illustrate massage bar 750 mounted on an implementation of surface mounts 900. Although described as a surface "mount", the surface mounts 900, 951 do not require that the mounts themselves be mounted to any particular surface, but merely that the massage bars 750, 994 can mount into the surface mounts 900, 951 for placement and use on the floor, wall or other surface. In the implementation of FIGS. 14-16, a base side of the surface mounts 900 is configured to rest on a flat or substantially flat surface. A top side 915 of the surface mount 900 may comprise a curved slot 910, groove, or channel configured to hold a handle 752 or shaft 753 of the massage bar 750. In one implementation, the curved slot 710 extends all the way from one side wall of the surface mount 900 through to an opposing side wall of the surface mount 900. In the implementation illustrated in FIGS. 14-16 each surface mount comprises a larger slot 910 and a small slot 905 that together form a channel that extends from one side wall of the surface mount 900 through to an opposing side wall of the surface mount 900. In still other implementations, the surface mount 900 may comprise only one slot 910 that extends only partially within the surface mount 900.

Referring specifically to FIG. 16, an exemplary use of the surface mount 900, massage bar 750, and massage apparatus 600. Various implementations of the surface mount 951, massage bar 994, and massage apparatus may be similarly utilized. The surface mounts 900 allow a user to utilize the massage apparatus(es) 600 to massage his or her back or any other body part without the assistance of others. The surface mounts 900 are configured to lift the massage bar 750 high enough off the ground that the massage apparatuses 600 do not touch the ground surface when the massage bar 750 is resting in the curved slot 910. As previously described, the massage apparatuses 600 are pivotally or rotationally coupled about the shaft 753. Accordingly, in combination with the surface mount 900, the massage apparatuses 600 may rotate freely about an axis formed by the shaft 753 when the massage bar 750 is resting on or within the surface mount 900. A user may then lay his or her body on the massage apparatuses 600, as shown, and move in various directions, thus causing the massage apparatuses 600 to roll over his or her body without the assistance of others.

Figure 17:
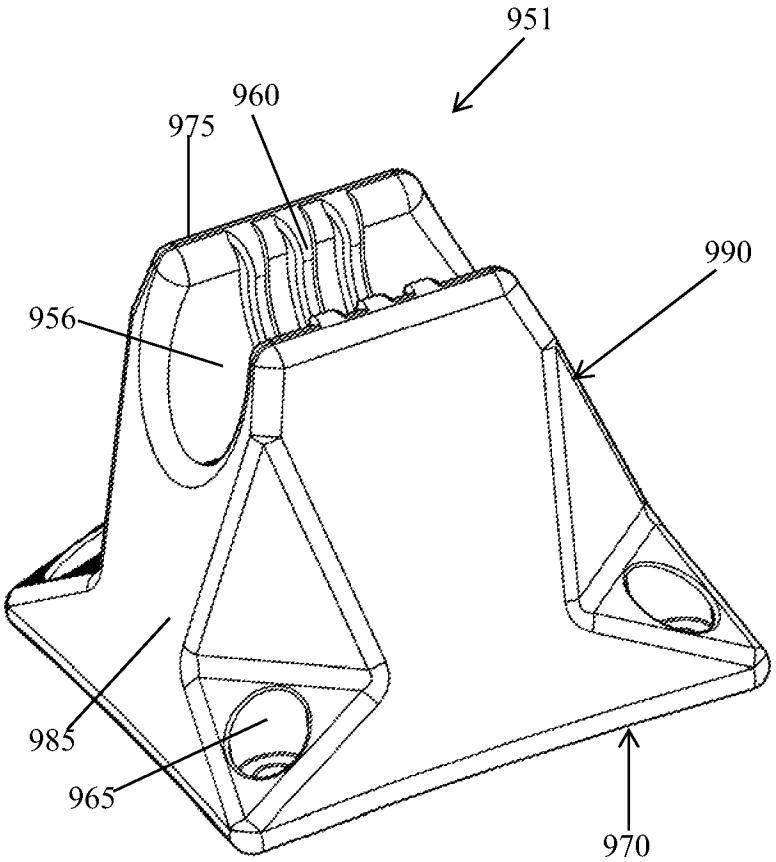
FIG. 17 is a top perspective view of a ribbed surface mount.

FIG. 17 illustrates a ribbed surface mount 951. Ribbed surface mount 951 may function similar to surface mount 900, but provides additional features that may be added to surface mount 900. Ribbed surface mount 951 comprises a curved slot 956 or groove on the top side 975 that creates a channel all the way from a first wall 985 to an opposing second wall 990. In other implementations, the curved slot 956 may only partially extend into either first wall 985 or second wall 990.

The curved slot 956 of ribbed surface mount 951 further comprises at least one rib 960 that extends inward from the curved slot 956. As shall be shown in FIGS. 21-23, the at least one rib may function to assist in mounting the massage bar 994 to the ribbed surface mounts 951. The dimensions of the rib 960 may vary according to different embodiments, and may therefore extend only partially along the curved slot 956, or alternatively extend from the top side 975 to the bottom of the slot 956 to the opposing top 975 side. In the implementation illustrated in FIG. 17, the ribs 960 are substantially parallel to the first 985 and second 990 walls. In other implementations, the ribs 960 may run perpendicular to the walls 985, 990, or any other angle relative to walls 985, 990. In still other implementations, similarly situated grooves may be used in place of ribs.

Implementations of the ribbed surface mount 951 may further comprise screw holes 965 that extend through angled walls of a mounting base of the ribbed surface mount 951 to the bottom side 970 and post receivers that extend at least partially into the angled walls. The screw holes 965 may be utilized to securely fasten the ribbed surface mount 951 to the ground, a wall, a doorway, or any other surface.

Figure 18:
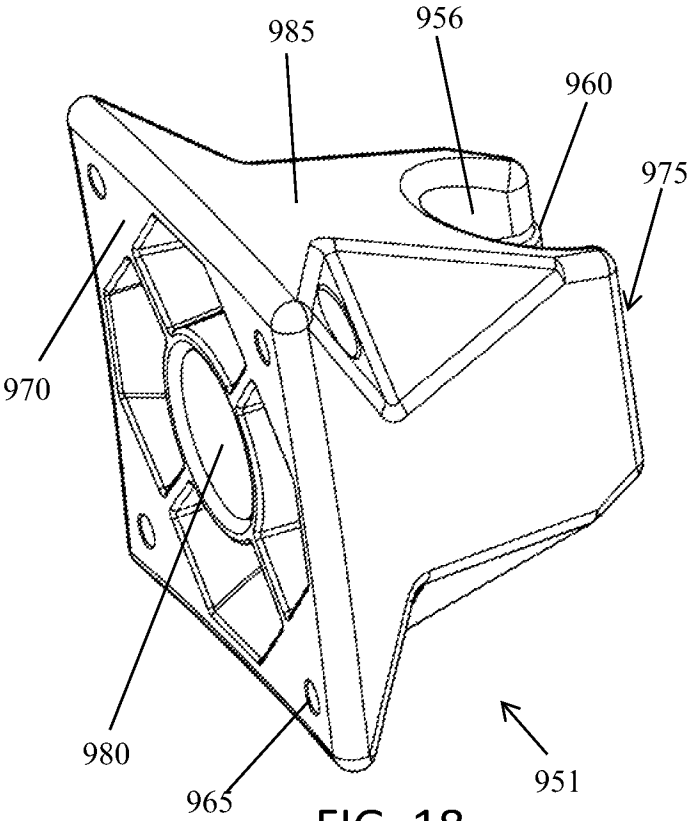
FIG. 18 is a bottom perspective view of a ribbed surface mount.

Referring now to FIG. 18, an implementation of the ribbed surface mount 951 may further comprise aperture 980 on the bottom side 970 of the ribbed surface mount 951. In the implementation of FIG. 18, the aperture 980 is configured to hold at least a portion of the handles 995 or shaft 753 within the aperture 980. In various implementations, the aperture 980 may extend all the way through the surface mount 951 from the bottom side 970 to the top side 975, or may alternatively extend only partly into the ribbed surface mount 951.

Figure 19:
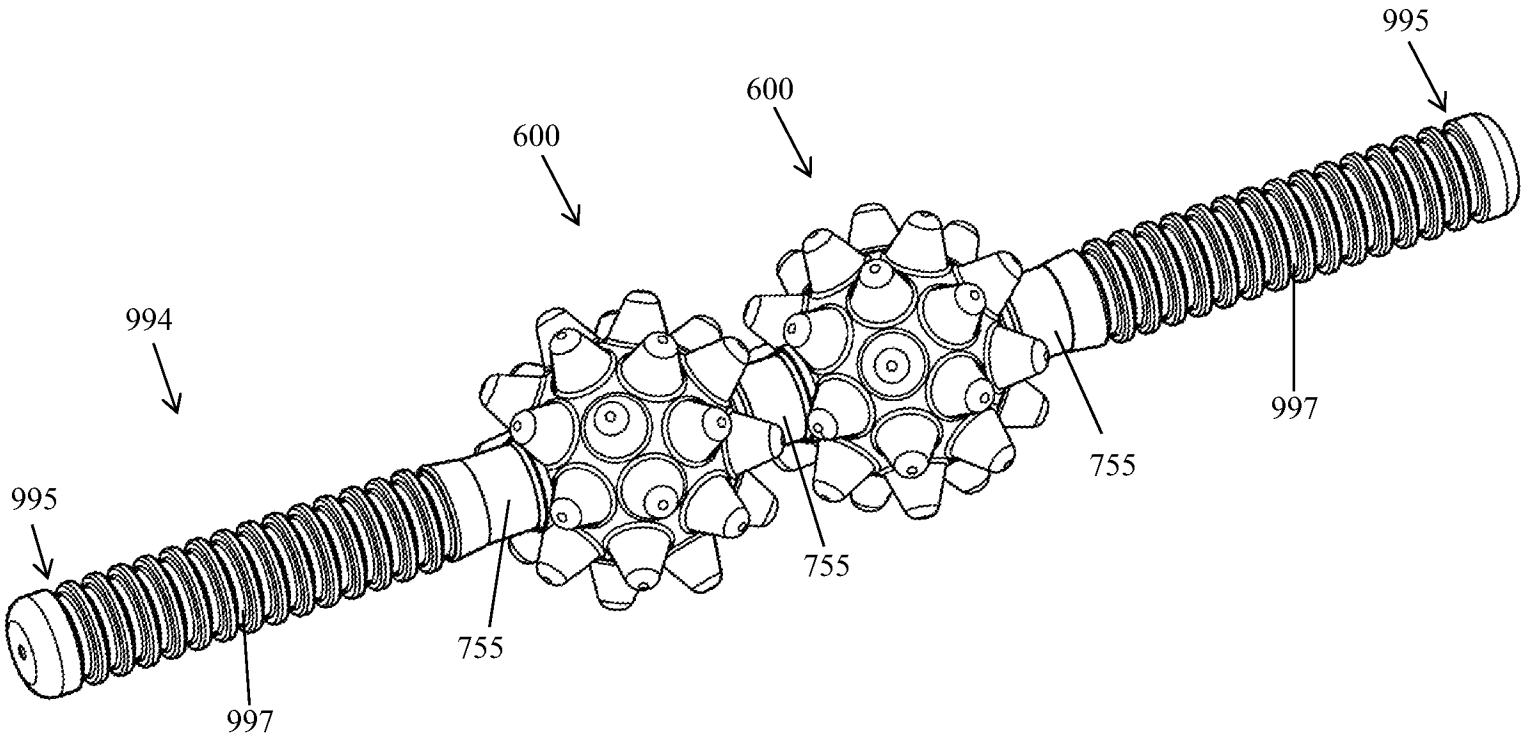
FIG. 19 is a perspective view of a second implementation of a massage bar.

FIG. 19 illustrates a perspective view of an implementation of a massage bar 994. Like previously described massage bar implementations, massage bar 994 may comprise massage apparatuses 600 and sleeves 755. The massage bar 994 further comprises handles 995 on opposing ends of the massage bar 994. While massage bar 994 may comprise handle 752 as previously illustrated, an implementation may comprise grooved handles 995. The grooved handles 995 may comprise at least one groove 997 configured to fit the rib 960 of surface mount 951 within the groove 997. Various implementations of grooved handles 995 may comprise any number of grooves 997. In still other implementations, the handles may comprise ribs that are configured to fit within grooves on an implementation of a surface mount.

Figure 20:
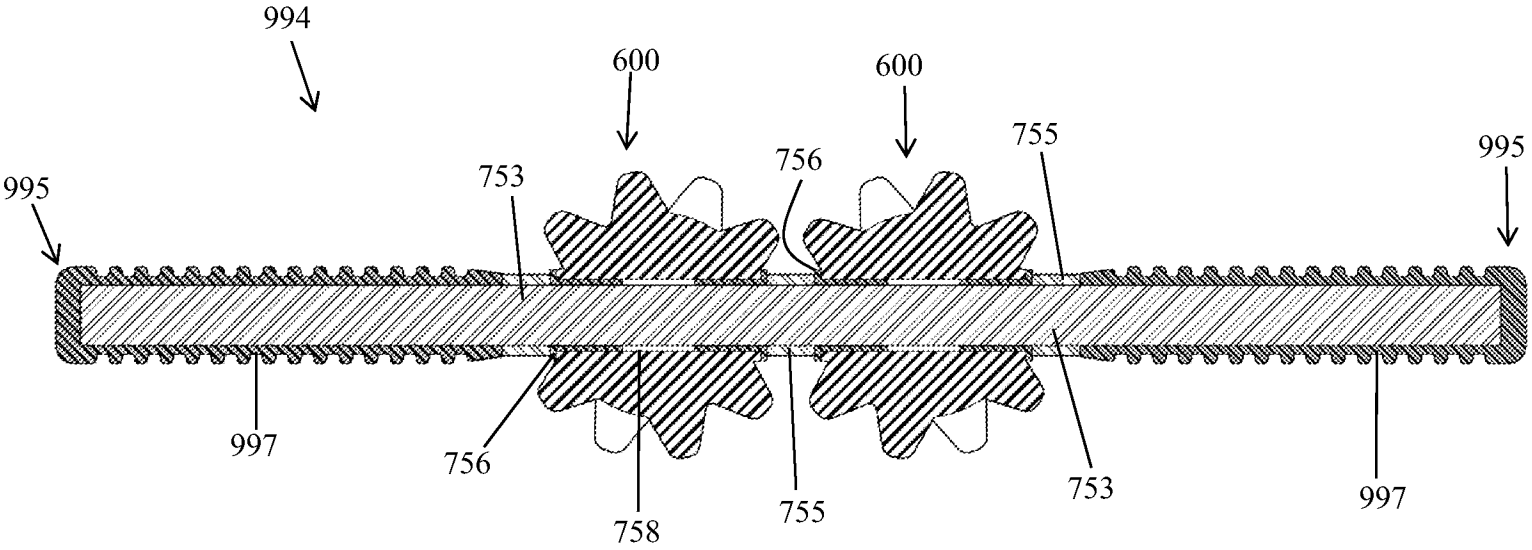
FIG. 20 is a cross-sectioned view of a second implementation of a massage bar.
Figure 21:
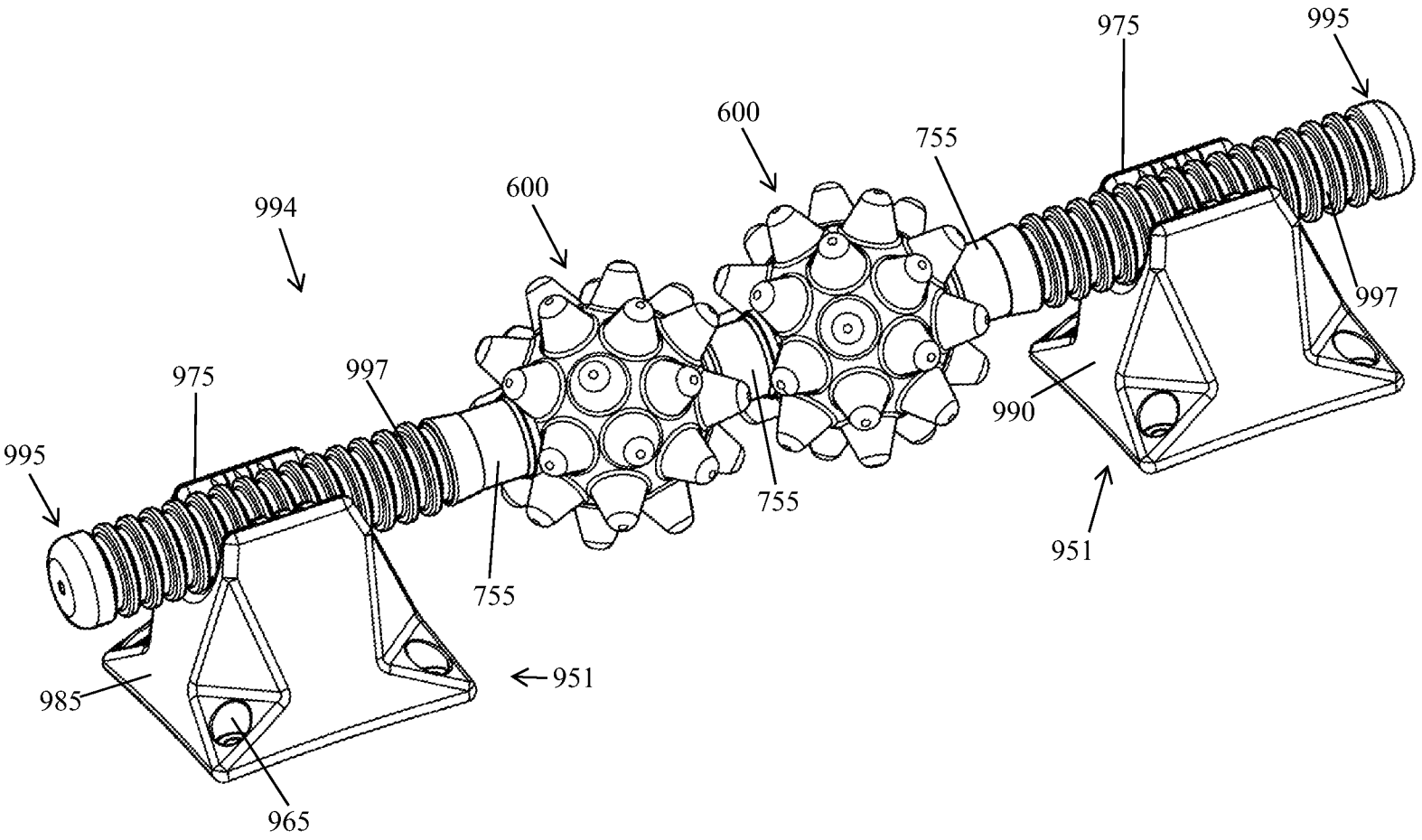
FIG. 21 is a perspective view of a second implementation of a massage bar mounted on ribbed surface mounts.
Figure 22:
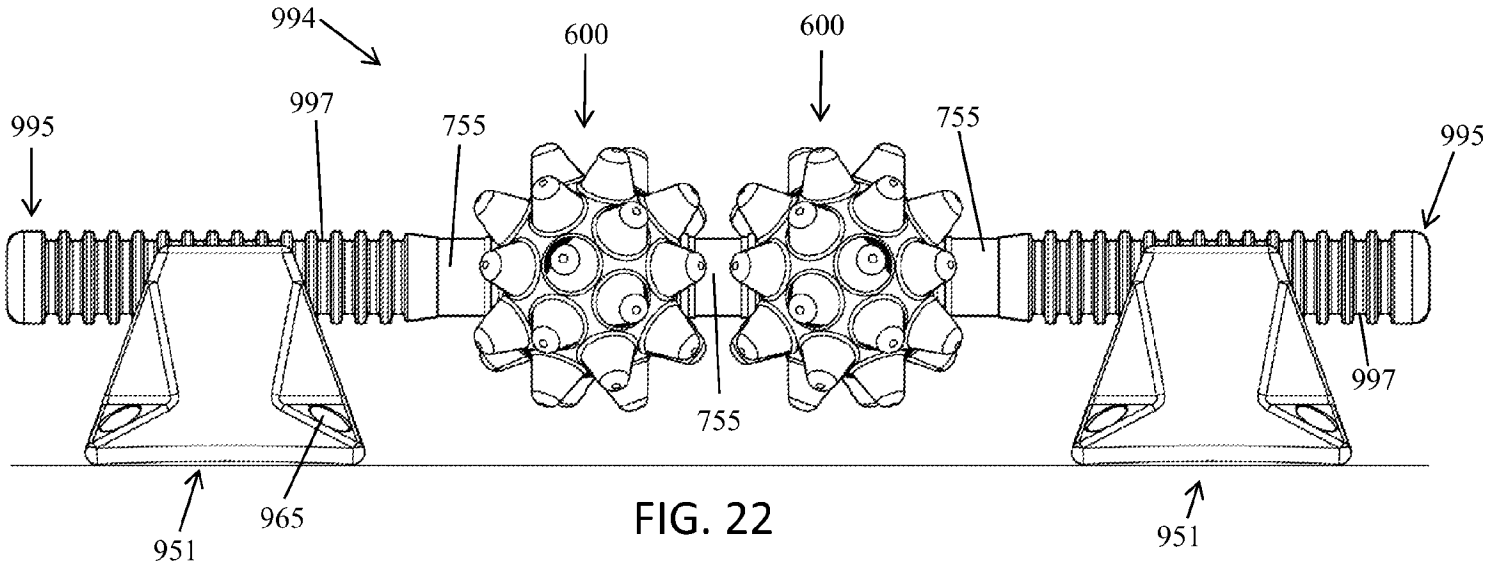
FIG. 22 is a perspective view of a second implementation of a massage bar mounted on ribbed surface mounts.
Figure 23:
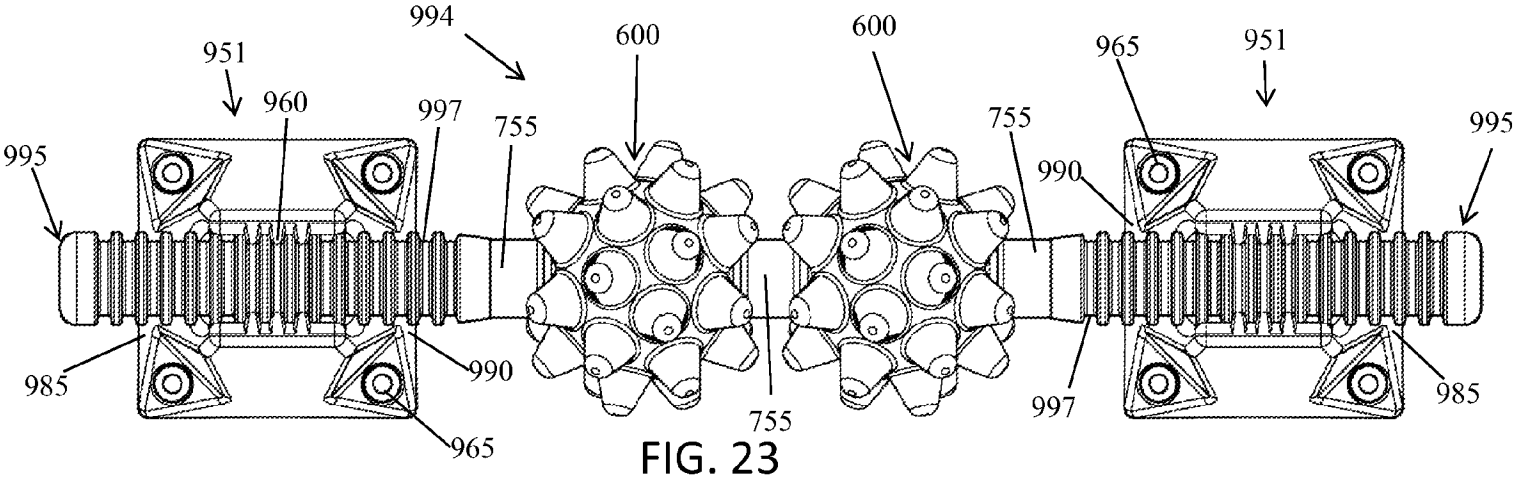
FIG. 23 is a top view of a second implementation of a massage bar mounted on ribbed surface mounts.

FIG. 20 illustrates a cross section view of massage bar 994. As previously noted, massage bar may comprise a similarly situated shaft 753, sleeves 755, massage apparatus bore holes 758, and flange bearings 756. As shown, the shaft 753 is not externally visible. In other implementations, however, the shaft 753 may be externally visible or exposed. In still other implementations, the massage bars 750, 994 may function without handles 995, 752.

While the implementation of FIG. 20 comprises a single cylindrical shaft 753 with a uniform diameter, other implementations are not so limited. In another implementation, multiple shafts may be coupled together, or shaft may comprise a thinner, pin like element that extends through the massage apparatuses 600. In still other implementations, any combination of shafts or other elements that allows for the rotation of the massage apparatus about an axis formed by the shaft may be utilized.

FIGS. 21-24 illustrated various views of massage bar 994 mounted on ribbed surface mounts 951. The combination of the grooved handles 995 and ribbed surface mounts 951 provide additional stability to the system. By placing the ribs 960 within the grooves 997, the massage bar 994 is less likely to slide about in undesired directions while in use. This allows for increased pressure to be placed on the massage apparatuses 600 (as shown in FIG. 16) without concern that massage bar 994 will slip out of the ribbed surface mounts 951.

Figure 24:
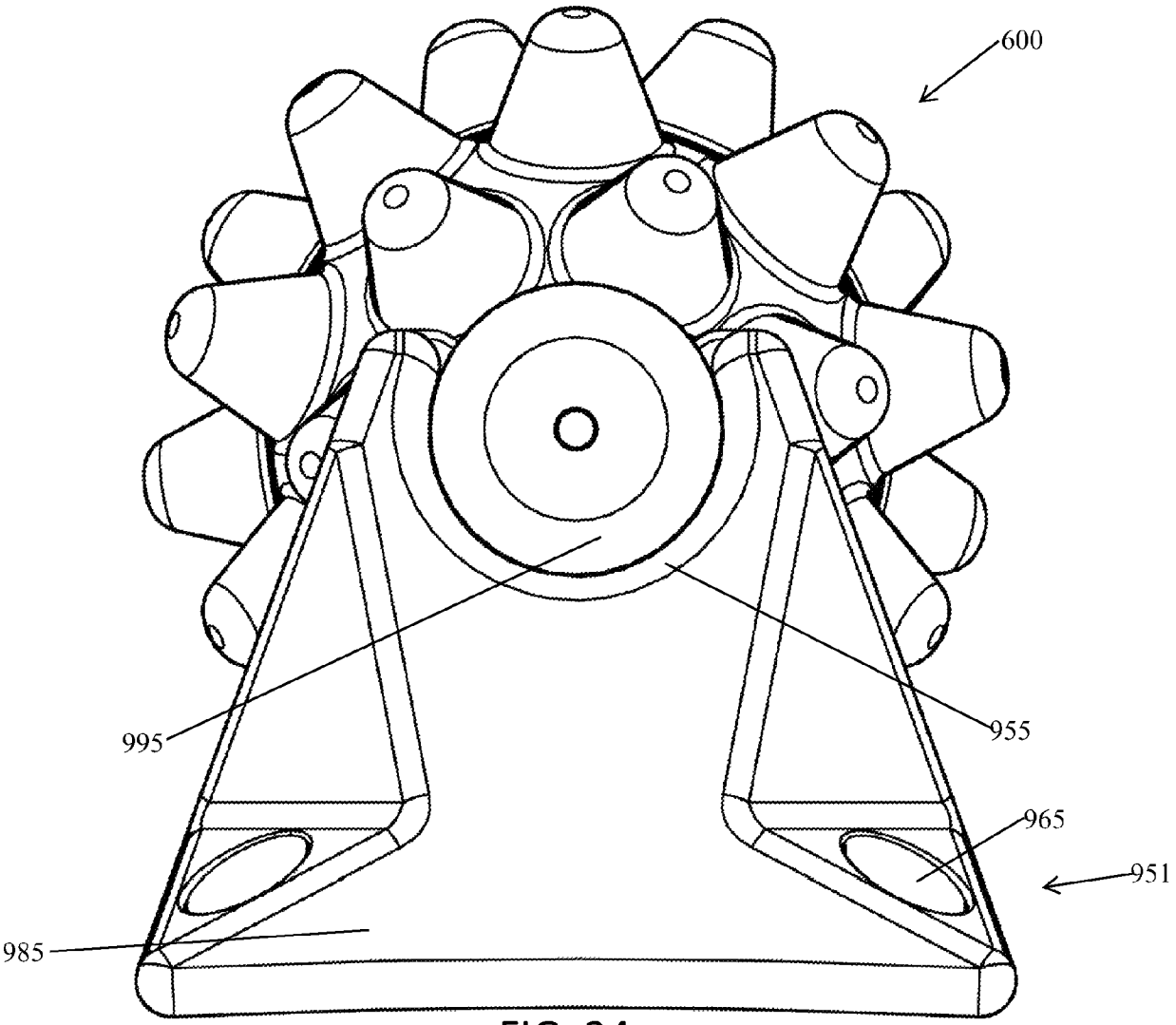
FIG. 24 is a side view of a second implementation of a massage bar mounted on ribbed surface mounts.

Referring particularly to FIG. 24, in an implementation the curved slot 956 may, when viewed from the side, comprise a curve that is greater than a half-circle. As such, the top sides 975 of the curved slot 956 are at least partially biased against the handles 995 when the massage bar 994 is insert into the ribbed surface mounts 951. Other implementations may comprise biased elements or clips similar to the mounting elements 805 of the telescoping doorway mount 800. Still other implementations may comprise straps, clips, clamps, or other elements configured to hold the handle 995 within the ribbed surface mount 951.

Figure 25:
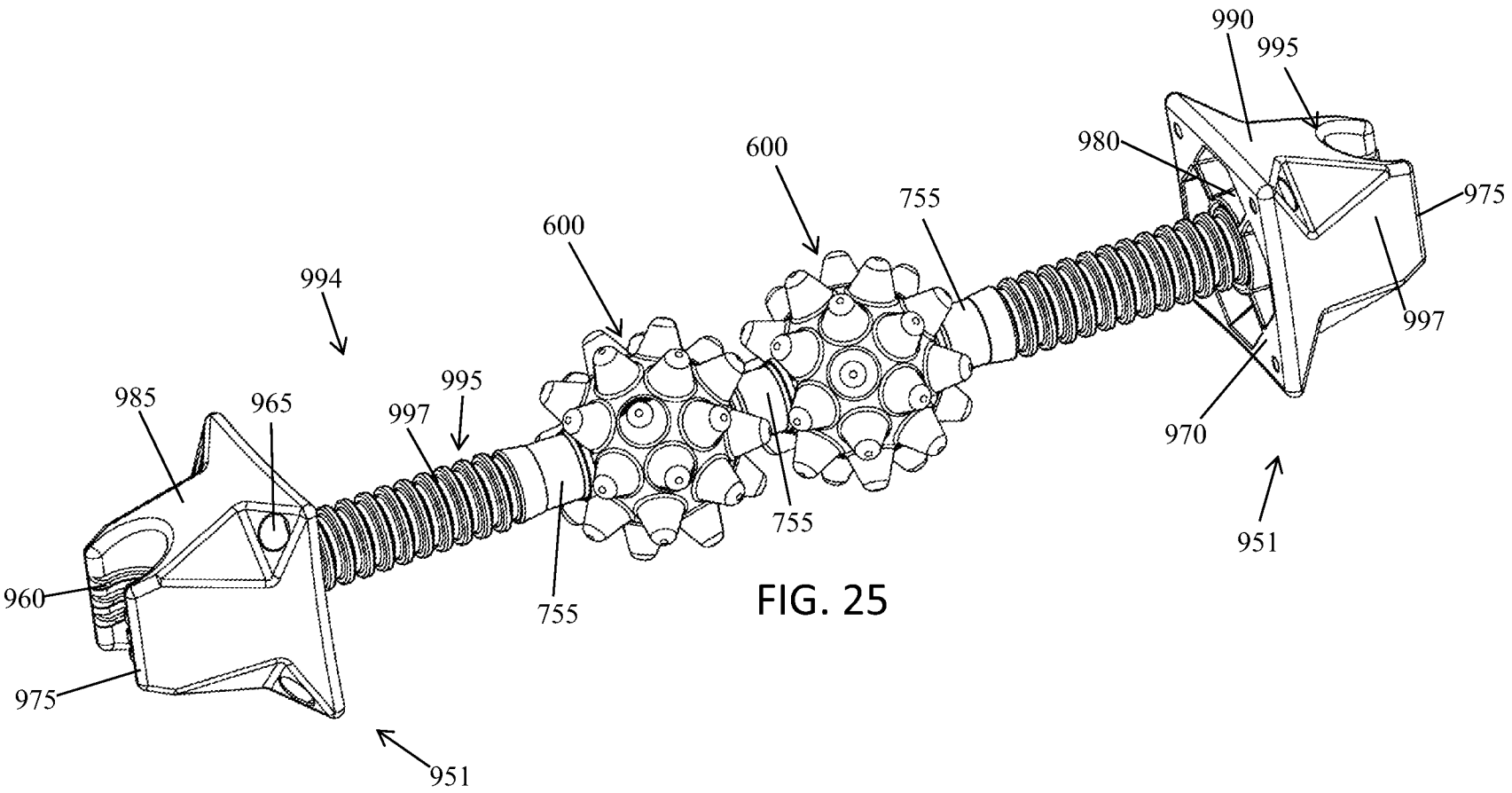
FIG. 25 is a perspective view of a second implementation of a massage bar mounted in bottom apertures on the ribbed surface mounts.

FIG. 25 illustrates another function of an implementation of ribbed surface mounts 951. Here, the handles 995 of massage bar 994 are within the apertures 980 of ribbed surface mounts 951. Such a configuration allows for more efficient shipping and packaging of the massage bar 994, massage apparatuses 600, and ribbed surface mounts 951. In the illustrated configuration or assembly, the ribbed surface mounts 951 keep the massage bar 994 centered in a box and eliminate the need for package inserts or fillers, while simultaneously occupying less space than if assembled in a typical manner.

In implementations where the aperture 980 extends all the way through the ribbed surface mount 951, the ribbed surface mount 951 may be mounted to a wall, a floor or doorway, as non-limiting examples of surfaces. Once two surface mounts 951 are mounted to opposing walls or doorways, a properly lengthened massage bar 994 may be placed within the apertures 980, thus mounting the massage bar 994 between the ribbed surface mounts 951. This implementation may utilize telescoping massage bar with two shafts that function similar to the telescoping aspect of the telescoping doorway mount 800 previously described.

Various implementations of mounting bodies for mounting of any of the massage apparatuses or massage balls disclosed herein are also contemplated in this disclosure. As shown in FIGS. 26-33, different implementations of massage apparatuses may be mounted directly into a portion of any of the mounting body implementations disclosed herein. With specific reference to FIG. 26, the mounting body 5 comprises two opposing handles 3 each connected to a mounting shoulder 7 via opposing a different elbow 4. Although the mounting body 5 shown in FIG. 26 comprises two opposing handles 3, a mounting body with a similarly configured mounting shoulder 7 with only one elbow 4 and one handle 3 is also contemplated.

Figure 26:
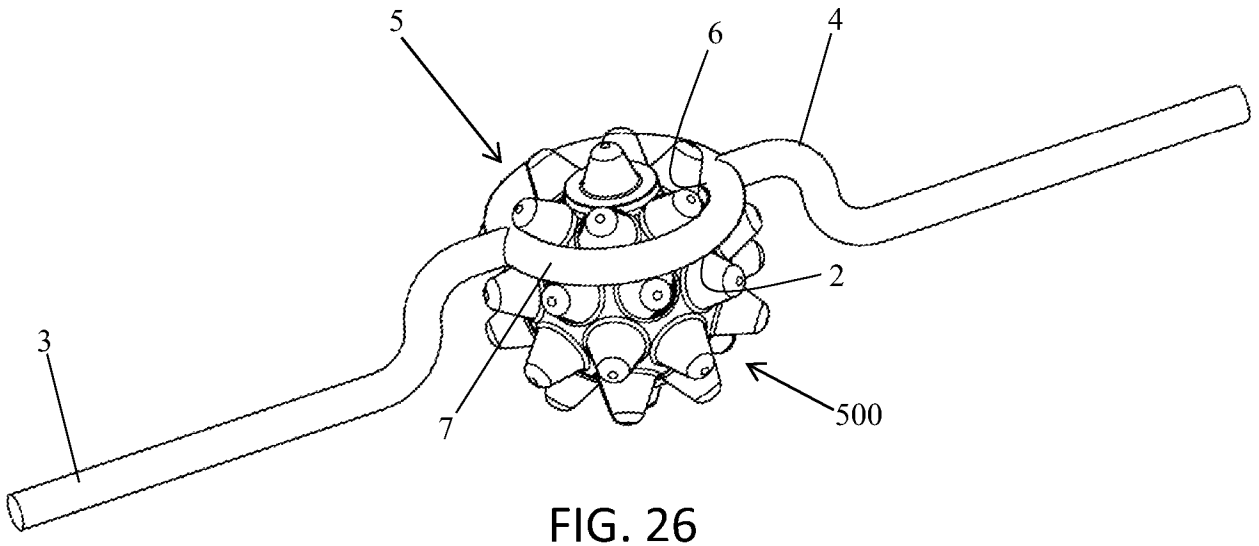
FIG. 26 is a perspective view of massage apparatus mounting to a first implementation of a mounting body.

The mounting shoulder 7 of mounting body 5 shown in FIG. 26 comprises a continuous ring that is substantially circular. As it shall be shown with respect to other implementations disclosed herein, however, mounting shoulder 7 may, in other implementations, comprise a discontinuous circular ring, a discontinuous polygonal ring, or a continuous polygonal or circular ring or any other shaped ring that meets the needs of this disclosure. In particular implementations, a mounting shoulder 7 comprises an inner boundary 6 that surrounds or circumnavigates a majority of one entire portion of a massage ball 500 when a massage ball 500 is held within the mounting shoulder 7. In particular implementations, such as that illustrated in FIG. 26, the mounting shoulder 7 may completely surround an entire portion of the massage ball 500 due to a complete circle being formed by the mounting shoulder 7 and inner boundary 6 of the mounting shoulder 7. As shall be shown in other implementations, the inner boundary may only surround a majority of a portion of the massage ball 500—or be an incomplete or discontinuous circle or polygon.

In a massage device system utilizing both the mounting body 5 and a massage ball, such as but not limited to a massage apparatus 500, the massage ball is inserted into the opening or aperture formed by the inner boundary 6 of mounting shoulder 7. Once inserted, the mounting shoulder 7 is removably entrapped between a plurality of fingers on the massage ball or a plurality of fingers on the massage ball and the massage ball itself. As previously described, the massage fingers may comprise flexible massage fingers that allow the massage ball to be pushed through the mounting shoulder 7 and hold the massage shoulder between a plurality of fingers or a plurality of fingers and the surface of the massage ball itself. In the implementation shown in FIG. 26, three massage fingers directly contact the inner boundary 6 of the mounting shoulder 7. These three massage fingers hold the mounting shoulder 7 interposed between them and four to six massage fingers that directly contact a bottom or outer surface 2 of mounting shoulder 7. Dependent upon the size of massage fingers, in other implementations, six massage fingers may directly contact the inner boundary 6 of the mounting shoulder 7.

Figure 27A:
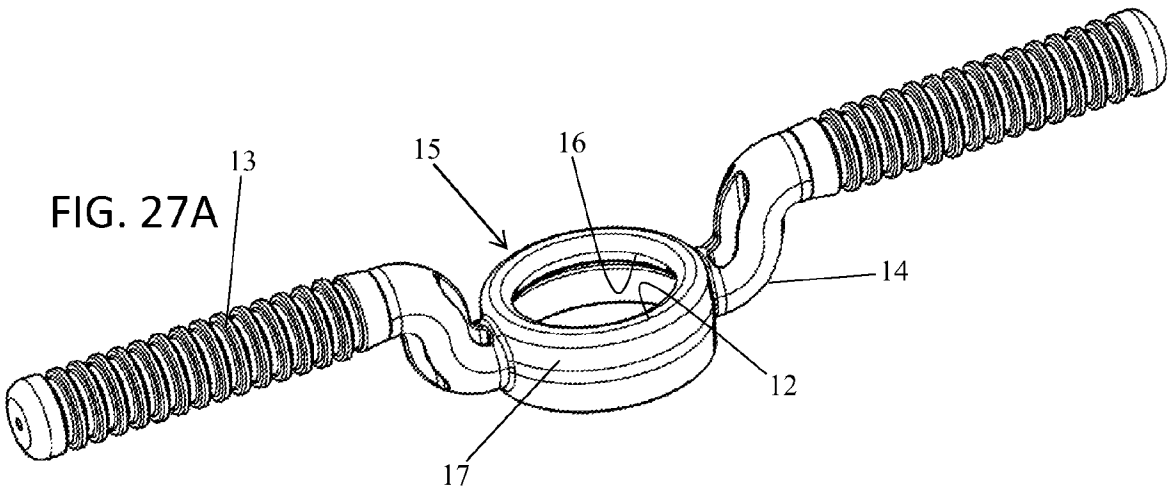
FIG. 27A is a perspective view of a second implementation of a mounting body.
Figure 27B:
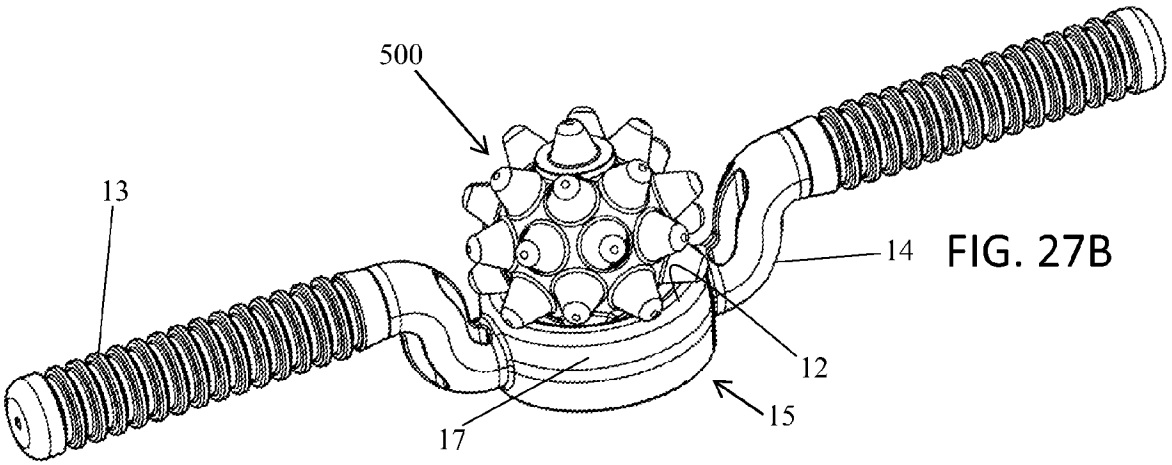
FIG. 27B is a perspective view of a massage apparatus mounted to a second implementation of a mounting body.

With specific reference to FIGS. 27A and 27B, an implementation of a mounting body may comprise a cylindrical body 15 that is either hollow or partially filled. In an implementation comprising a partially filled cylindrical body 15, the cylindrical body 15 comprises a mounting chamber similar to the mounting chamber 28 shown in FIGS. 28A and 28B. In the implementation shown in FIGS. 27A and 27B, however, the cylindrical body 15 comprises a hollow cylindrical body 15. While FIG. 27A illustrates only the cylindrical body 15, FIG. 27B illustrates a massage ball or device mounting system that includes massage apparatus 500, although any massage ball apparatus disclosed herein may be utilized with cylindrical body 15.

Similar to mounting body 5, cylindrical body 15 comprises a substantial circular mounting shoulder 17 with a continuous inner boundary 16 and continuous outer surface 12. Thus, mounting of massage ball 500 within the inner boundary 16 of mounting shoulder 17 is similar to that described elsewhere in this document.

Also similar to mounting body 5, cylindrical body 15 comprises two opposing handles 13 coupled to the mounting shoulder 17 with opposing elbows 14. In the implementations shown in FIGS. 27A-28A, as well as other implementations contemplated herein, the handles 13 are fashioned to include grips that allow for better grasp of the cylindrical body 15 by a user. Elbows 14 are also thicker, providing greater support for the handles 13. Elbows 14 may be hollow, filled, or any combination thereof. In a particular implementation, elbows 14 are removably coupled to the mounting shoulder 17.

Figure 28B:
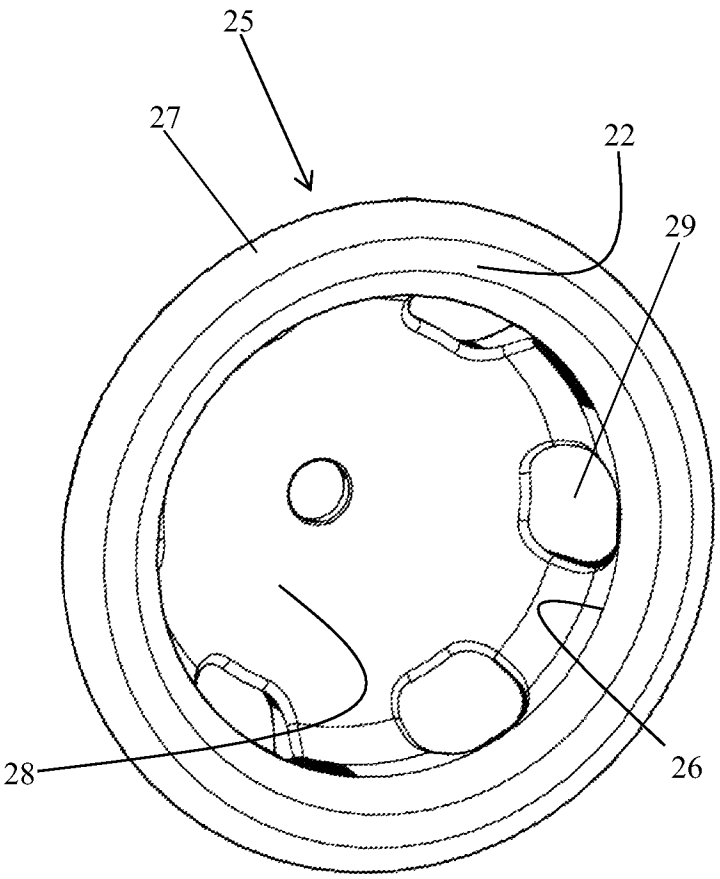
FIG. 28B is a front perspective view of a third implementation of a mounting body.
Figure 28A:
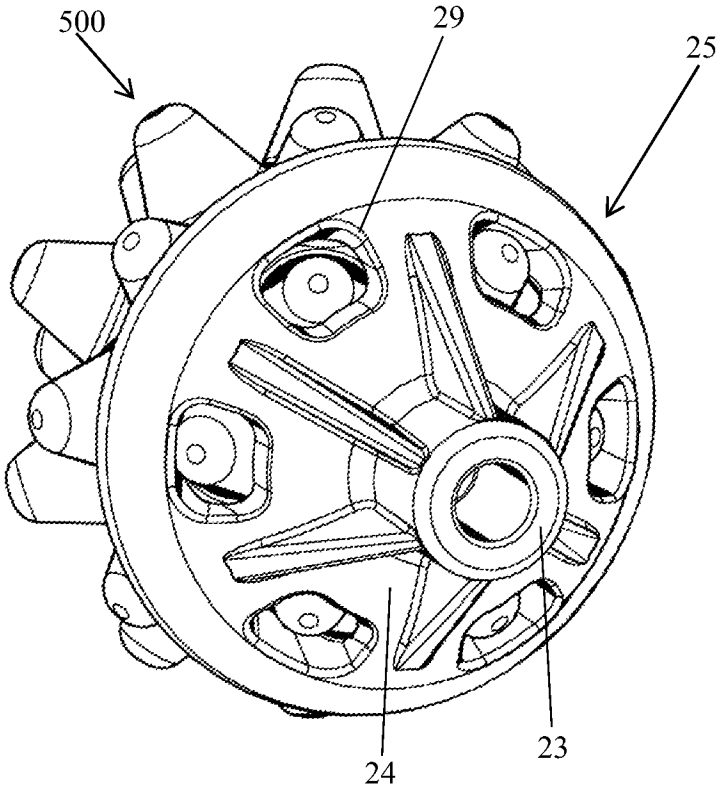
FIG. 28A is a rear perspective view of a massage apparatus mounted to a third implementation of a mounting body.

With specific reference to FIGS. 28A and 28B, various implementations of mounting bodies may comprise a mounting body 25 that includes a mounting base 24 either integral with mounting shoulder 27 or coupled to mounting shoulder 27. The particular mounting base 24 shown in FIG. 28B comprises a semi-spherical mounting chamber 28. Mounting chamber 28, if used, is typically sized to house a portion of massage apparatus 500 (or any massage ball or apparatus coupled therein). Mounting chamber 28 further comprises a plurality of finger apertures 29 each sized and positioned to allow a different massage finger to protrude at least partially through the finger aperture 29. In the implementation shown in FIGS. 28A and 28B, the mounting chamber 28 comprises six finger apertures 29; other implementations, however, may comprise two, three, four, five, seven, or more finger apertures 29.

An implementation of a mounting base 24 may further comprise a coupling 23 on the opposing side of the mounting chamber 28. The coupling may comprise a slot that allows for insertion of a rod, or may alternatively comprise threading that allow for threaded coupling to a screw or bolt. In the implementation shown in FIG. 28A, coupling 23 extends outward from mounting base 24, although this is not required in every implementation. Mounting base 24 further comprises a plurality of supports that extend from the mounting base 24 to the protruded coupling 23 in the particular implementation of FIG. 28A.

Similar to mounting bodies 5 and 15, mounting body 25 comprises a substantial circular mounting shoulder 27 with a continuous inner boundary 26 and continuous outer surface 22. Thus, mounting of massage ball 500 within the inner boundary 16 of mounting shoulder 17 is similar to that described elsewhere in this document. Once inserted, however, massage ball 500 is partially housed within mounting chamber 28 with six massage fingers at least partially extending into or through six finger apertures 29.

Figure 29B:
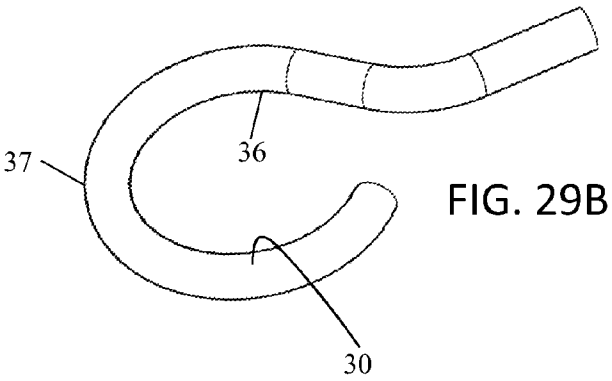
FIG. 29B is a perspective view of a circular discontinuous mounting shoulder.
Figure 29C:
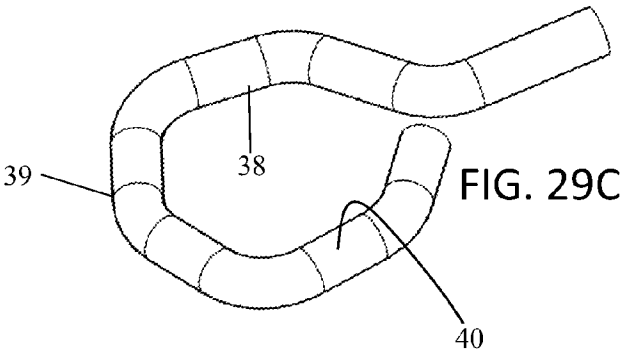
FIG. 29C is a perspective view of a polygonal discontinuous mounting shoulder.
Figure 29A:
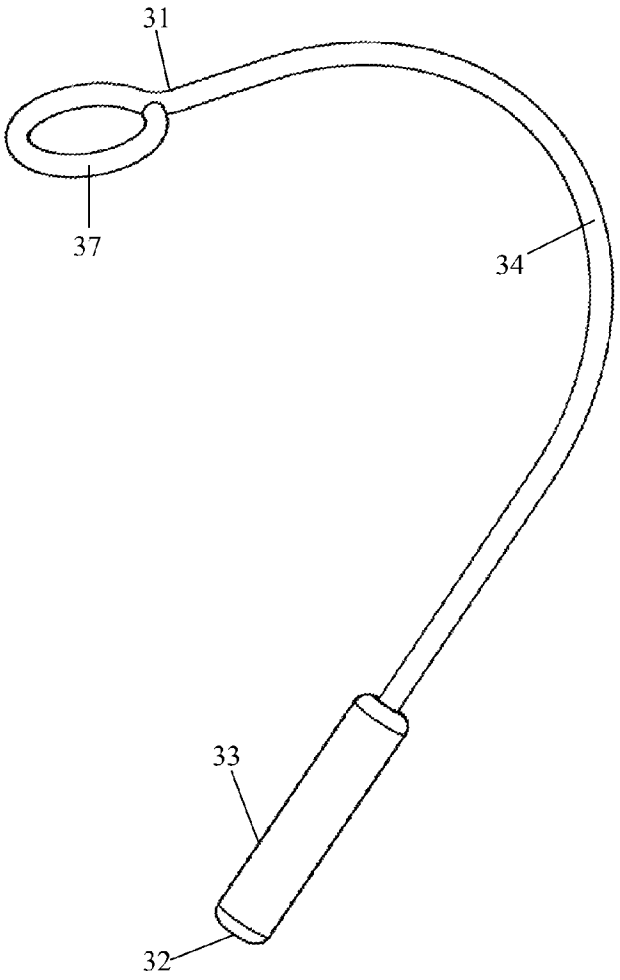
FIG. 29A is a perspective view of a fourth implementation of a mounting body.

With specific reference to FIGS. 29A-C, different implementations of mounting bodies contemplated herein may comprise a mounting body 35 with a mounting shoulder 37 or 39 disposed on a first end 31 of a J-shaped element 34. In some implementations, the entire J-shaped element 34 may be considered a handle, while in the implementation of FIG. 29A, a handle 33 or grip is coupled to a terminating end of the J-shaped element opposite the first end 31 and the mounting shoulder 37 or 39. Moreover, although shown as a J-shaped element 34 in FIG. 29A, in other implementations, a U-shaped, |-shaped element, or a C-shaped element may be used as an alternative to J-shaped element 34. The use of the extended handle allows a user to hold the handle and massage portions of the user's body including the user's back.

As shown in FIGS. 29A and 29B, mounting body 35 may comprise a substantially circular mounting shoulder 37. In contrast to the implementations shown in FIGS. 26-28, however, mounting shoulder 37 comprises a discontinuous inner boundary 36 and outer surface 30. Thus, the inner boundary 36 and outer surface 30 of mounting shoulder 37 surround only a majority of the portion of the massage ball removably coupled to the mounting shoulder 37. A discontinuous ring, such as mounting shoulder 37, typically reduces the cost of manufacture of the mounting body 35 and may ease insertion of the massage ball or apparatus into the mounting shoulder 37. Although shown with reference to a modified mounting body, FIG. 33B illustrates a massage ball or apparatus 500 with a discontinuous ring of a mounting shoulder 37 removably embedded between a plurality of massage fingers.

Similarly, polygonal mounting shoulder 39, as shown in FIG. 29C, comprises a discontinuous inner boundary 38 and outer surface 40. In contrast to the implementation of FIG. 29B, however, mounting shoulder 39 comprises a polygonal mounting shoulder 39 with a polygonal inner boundary 38. In FIG. 29B, polygonal mounting shoulder 39 comprises a hexagonal mounting shoulder. Other implementations, however, may comprise other polygon base configurations, such as but not limited to triangles, squares, pentagons, heptagons, octagons, or any other n-sided polygon. In specific implementations, the polygon utilized is adapted to fit a particular massage ball or apparatus, or particular configured to engage with a specific number of massage fingers. Moreover, specific polygonal configuration of the mounting shoulder 39 allows for easier insertion of the massage ball or apparatus, and may also aid in resisting rotation of the massage ball once the massage ball is mounted within mounting shoulder 39.

In either mounting shoulder 37 or mounting shoulder 39, the degree of opening in the discontinuous portion of the mounting shoulder 37 is between 1 and 179 degrees. In a particular implementation, the degree of opening in the discontinuous portion is approximately 90 degrees.

Figure 33A:
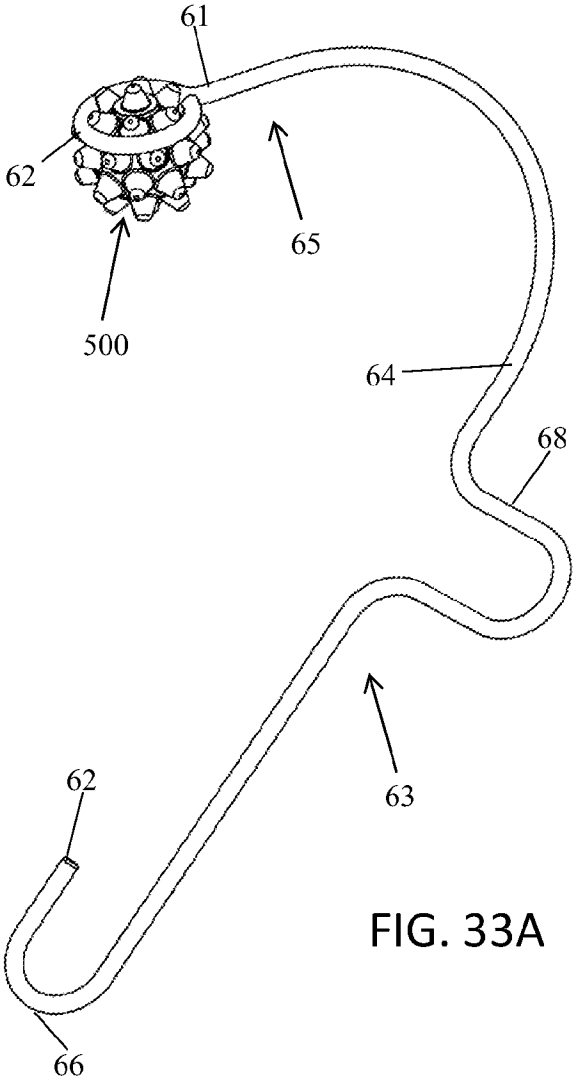
FIG. 33A is a perspective view of a massage apparatus mounted to an eighth implementation of a mounting body.
Figure 33B:
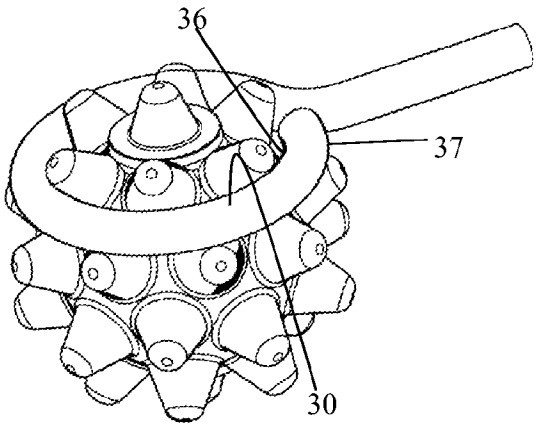
FIG. 33B is a perspective view of a massage apparatus mounted to a discontinuous circular mounting shoulder.

Similar to the implementation of FIG. 29A, mounting body 65 shown in FIGS. 33A and 33B comprises a discontinuous mounting shoulder 37 coupled to a J-shaped element 64. The J-shaped element 64 of the implementation shown in FIG. 33A, however, comprises a hook 66 proximate a terminating end 62, and a U-shaped reentrant opening 68 positioned between the terminating end 62 and the first end 61. As with mounting body 35, the J-shaped element 64 of mounting body 65 may alternatively comprise a U-shaped, I-shaped, or C-shaped element. Moreover, although a hook 66 is shown on terminating end 62 of mounting body 65, other implementations may comprise a handle similar to the handle 33 of mounting body 35. Likewise, the U-shaped reentrant opening 68 may alternatively comprise a rod or other extension, typically positioned to allow a user to grip the handle 33 or hook 66 with one hand, and grab the reentrant opening 68 or similarly positioned rod with the other hand.

Figure 30:
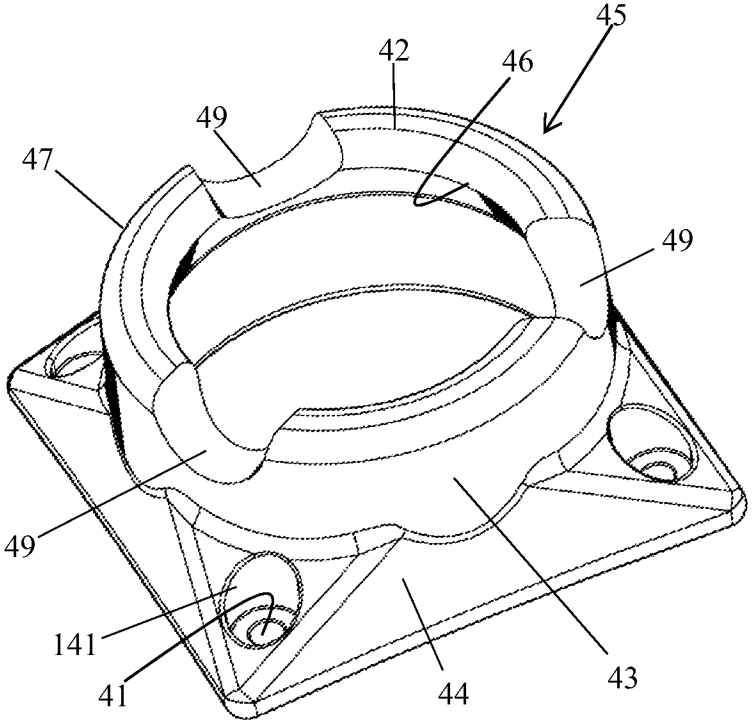
FIG. 30 is a perspective view of a fifth implementation of a mounting body.

With specific reference to FIGS. 30 and 31, various implementations of a mounting body may comprise a mounting body 45 that comprises a cylindrical body 43, a mounting base 44 coupled or integral with one end of the cylindrical body 43, and a mounting shoulder 47 or 57 on the cylindrical body 43 opposite the mounting base 44. In the implementation of FIG. 30, the mounting shoulder 47 comprises a discontinuous ring with three segments or spaces 49 that divide the discontinuous ring into three portions. Similarly, mounting shoulder 47 comprises a substantially circular discontinuous inner boundary 46 and outer surface 42, which each also comprise the same three segments or spaces 49. The segments may be equal in depth or dimensions, or may alternatively comprise differing dimensions. In this implementation, the three segments or spaces 49 in the inner boundary 46 allow for easier insertion of a massage ball into the mounting body 45. In use, a user may align the three segments 49 with three massage fingers on the massage ball, insert the massage ball into the opening of the mounting shoulder 47, then rotate the massage ball such that the three massage fingers that are positioned to directly contact the inner boundary 46 are no longer aligned with the three segments 49, but rather in direct contact with the inner boundary 46.

Figure 31A:
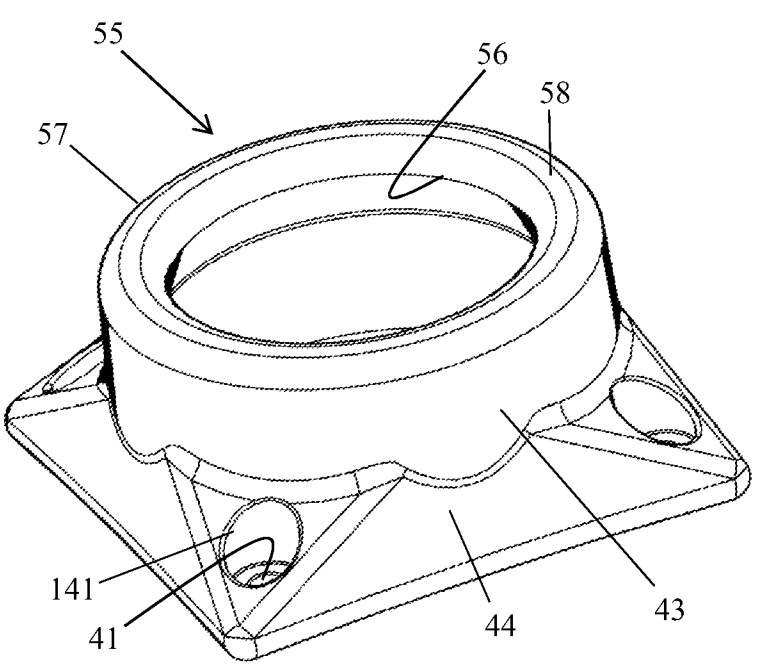
FIG. 31A is a perspective view of a sixth implementation of a mounting body.
Figure 31C:
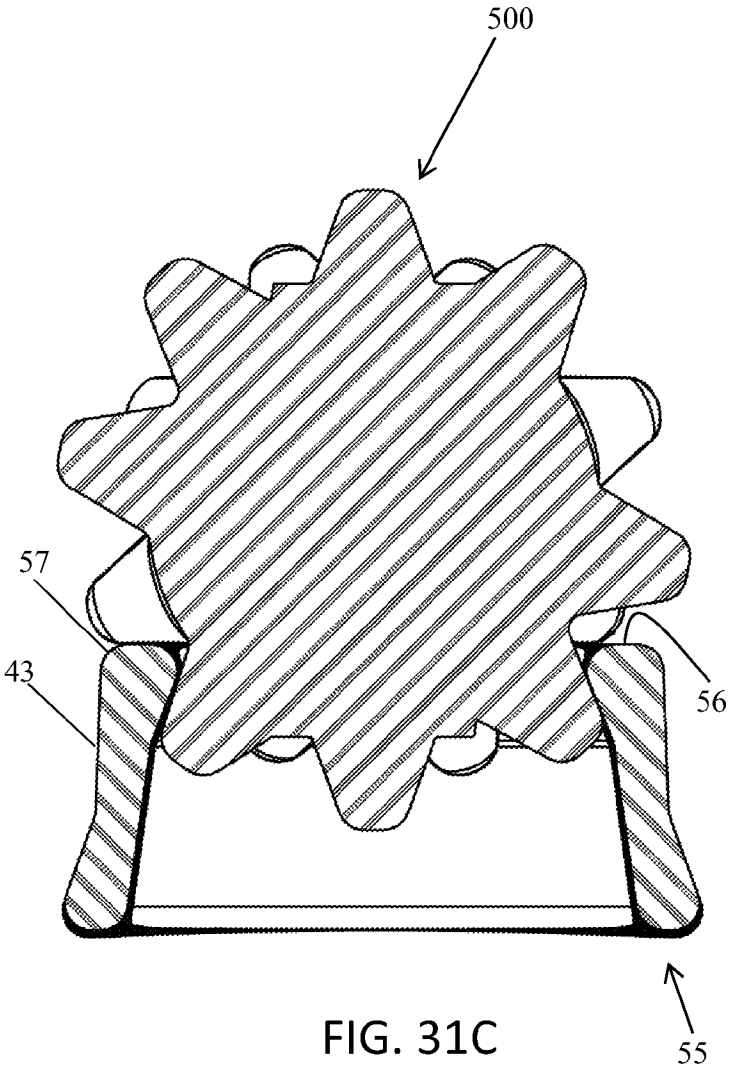
FIG. 31C is a cross-sectioned view of a massage apparatus mounted to a sixth implementation of a mounting body.
Figure 31B:
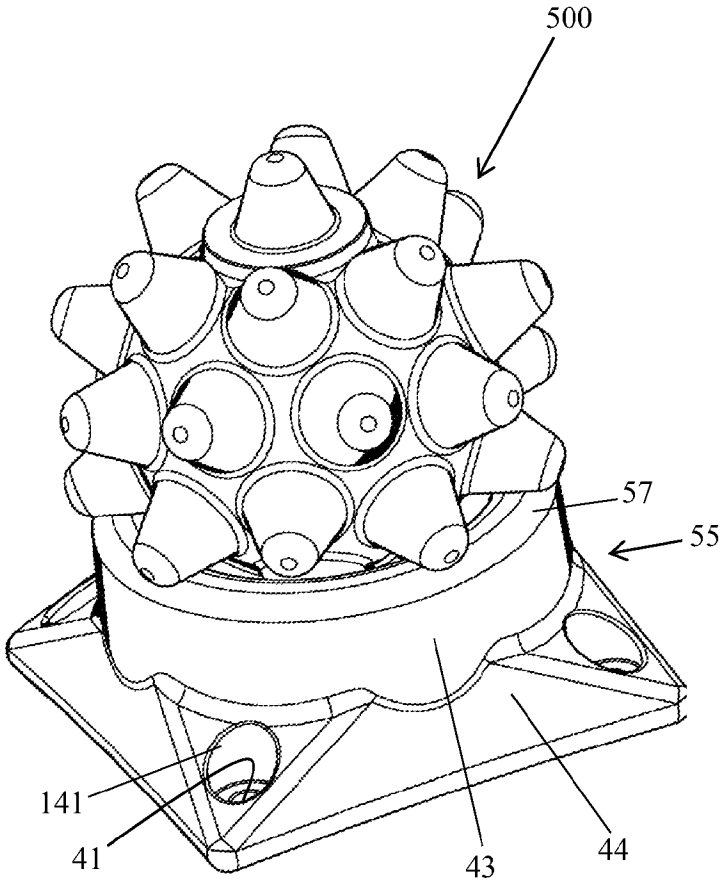
FIG. 31B is a perspective view of a massage apparatus mounted to a sixth implementation of a mounting body.

In contrast, the implementation of FIGS. 31A-C comprises a mounting body 55 with a mounting shoulder 57 that has no segments or spaces. The inner boundary 56 and outer surface 58 of mounting shoulder 57, then, comprise substantially circular continuous rings. FIG. 31C depicts a cross-sectioned view of a massage ball 500 mounted within the mounting body 55. As shown, in this particular implementation the inner boundary 56 comprises a lip the fits between a plurality of massage fingers on the massage ball 500. FIG. 31B illustrates a system that includes a mounting ball 500 mounted within mounting body 55. Although not shown, a mounting ball 500 mounted in mounting body 45 would have a similar appearance, with the inclusion, of course, of the segments or spaces 49 on the mounting body 45.

Mounting bodies 45,55 further comprise a mounting base 44 integral with or coupled to the cylindrical body 43. Mounting base 44 may be configured to lay flat on a flat surface, couple to another element, or both. In the implementations pictured in FIGS. 30-31, the mounting base 44 is configured to couple to a mounting wall or plate. Though not required in all implementations, mounting base 44 comprises a plurality of coupling apertures, such as screw holes 41, 995 or post receivers 141, positioned to align with mounting apertures on the mounting wall. Furthermore, mounting base 44 is substantially square or pyramid in shaped in the implementations shown in FIGS. 30-31, but may comprise any other suitable shape in other implementations that allows the mounting base to either stand upright or be coupled to a mounting wall. A screw, pin, or other device may be inserted through the apertures in the mounting base 44 and the mounting wall to couple the mounting base 44 to the mounting wall. The mounting wall may further comprise at least two mounting ridges that provide support or guide the mounting bases 44 in proper positions.

Mounting bodies 45, 55 may further comprise one or more screw holes 41. In the embodiment of FIGS. 30 and 31, the mounting bodies 45, 55 comprise four screw holes 41, each positioned near different corners of the mounting bodies 45, 55. The screw holes 41 typically extend all the way through the mounting body 45 but may, in some embodiments, extend only partially into the mounting bodies 45, 55. Some embodiments of the mounting bodies 45, 55 include a post receiver 141 adjacent to each of the screw holes 41. The post receivers 141 are typically, though not always, larger than the screw openings 41. The post receivers 141 may comprise any shape complimentary to posts 156. Post receivers 141 may by similarly applied to any mounting embodiment disclosed herein.

Figure 32:
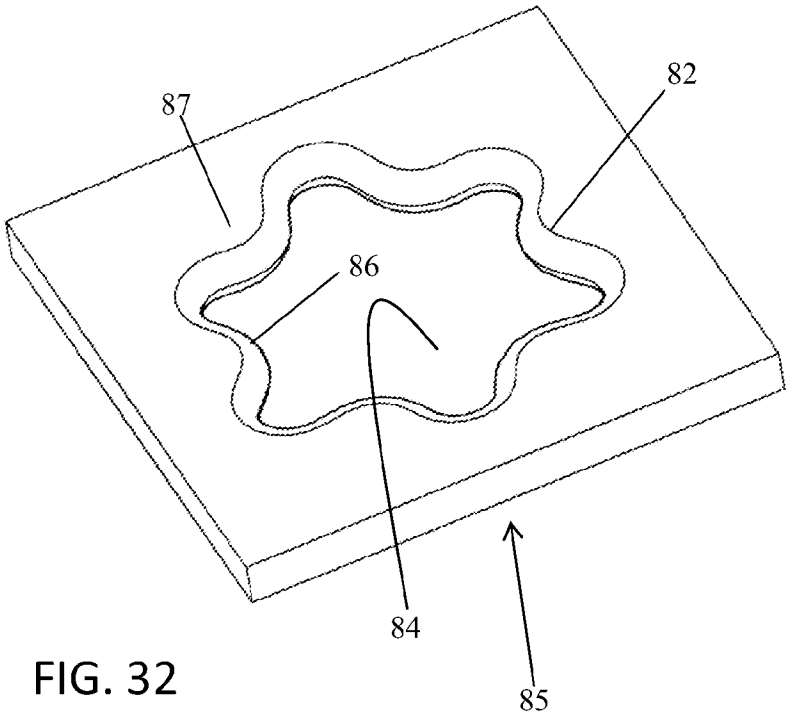
FIG. 32 is a perspective view of a seventh implementation of a mounting body.

With specific reference to FIG. 32, various implementations of the mounting body may comprise a mounting body plate 85 that includes a mounting aperture 84 therethrough. The mounting aperture 84 comprises a mounting shoulder that typically includes a continuous ringed inner boundary 86 and outer surface 82. In the implementation shown in FIG. 32, the mounting aperture 84 is shaped similar to a six-pointed star with rounded points and edges. Each of the points in the picture implementation are positioned to allow transfer of a different massage finger of a massage ball through the mounting opening 84. Once inserted, the mounting ball may be slightly rotated to hold the ball the mounting body plate 85.

Figure 34A:
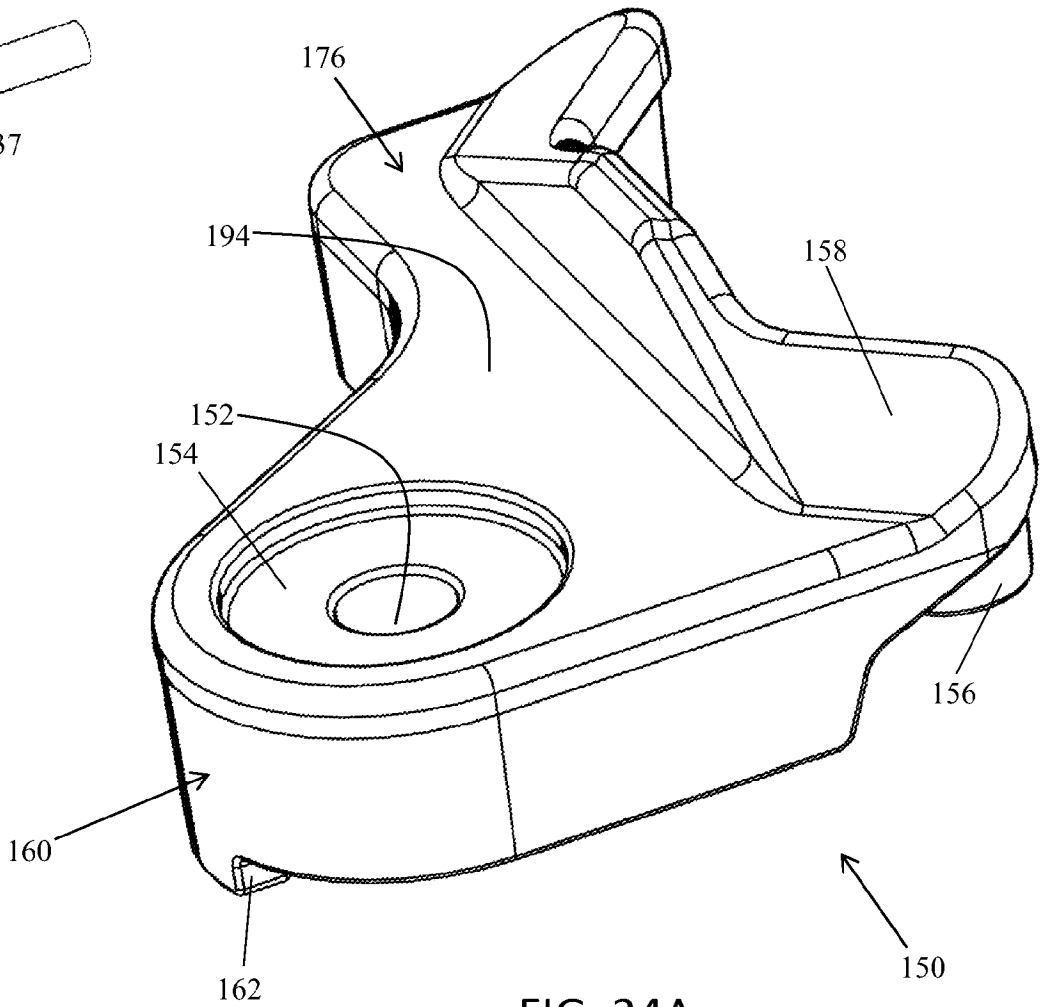
FIG. 34A is a top perspective view of a mounting clamp.
Figure 34B:
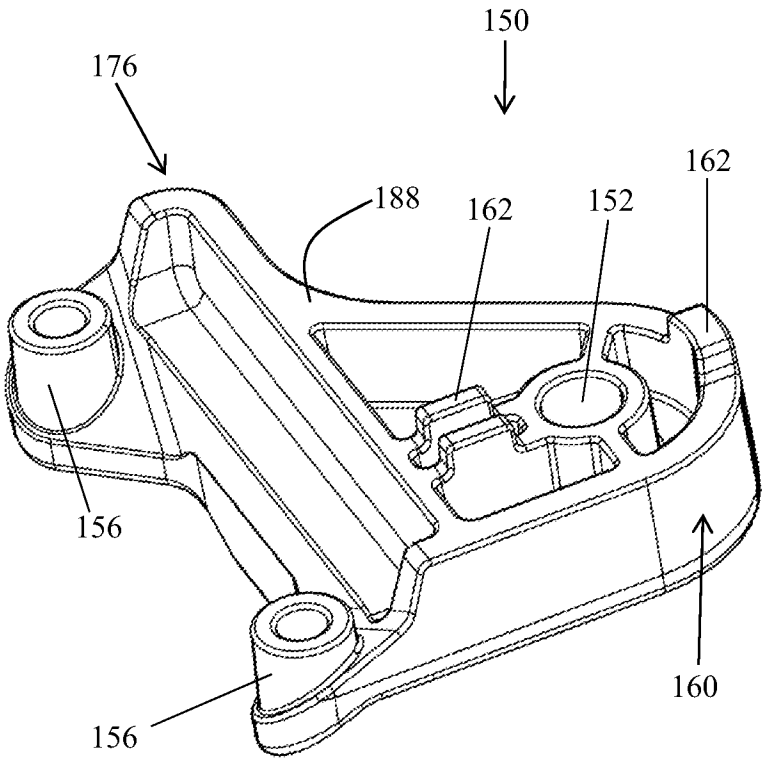
FIG. 34B is a bottom perspective view of a mounting clamp.

FIGS. 34A and 34B illustrate an embodiment of a mounting clamp 150 that may be used in conjunction with the surface mount 951 or mounting bodies 45, 55. Other surface mounts or mounting bodies disclosed herein may, with the addition of post receivers, be used conjunction with the mounting clamp 150. An embodiment of the mounting clamp 150 comprises a clamp head 160 and a clamp base 176. The clamp head 160 and the clamp base 176 are typically configured or shaped at least partially complementary to one another such that two mounting clamps 150 may be positioned side-by-side with the clamp head 160 of a first mounting clamp 150 partially abutting the clamp base 176 of a second mounting clamp 150, and the clamp head 160 of the second mounting clamp 150 partially abutting the clamp base 176 of the first mounting clamp 150 (shown in FIG. 36). In the embodiment of FIGS. 34A and 34B, the mounting head 160 is rounded. In other embodiments, however, the mounting head 160 may be squared, jagged, or any other shape that allows for complimentary fitting with the clamp base 176 of another mounting clamp 150. In still other embodiments, the mounting clamps are not configured to complement the shape of other mounting clamps.

Some embodiments of the mounting clamp 150 further comprise a top surface 194 and a bottom surface 188 opposite the top surface 194. A coupling hole 152 that extends through the mounting clamp 150 is typically positioned proximate the clamp head 160. Although not required, a washer cavity 154 may surround the coupling hole 152 on the top surface 194 of the mounting clamp 160. The top surface 194 may further comprise a ridge 158 on the clamp base 176. The ridge 158 is typically positioned as a convenient grip that allows a user to move the mounting clamp 150 along the track 180, or remove the mounting clamp 150 from the track 180. The clamp base 176 may further comprise a curved or non-planar end between the posts 156 that allows at least a portion of the mounting bodies 45, 55 or surface mount 951 to be positioned between the two posts 156 with the posts 156 are within the post receivers 141.

Various embodiments of the mounting clamp 150 further comprise one or more posts 156 and one or more guides 162 extending from the bottom surface 188 of the mounting clamp. In the embodiment shown in FIG. 34B, the mounting clamp 150 comprises two posts 156 and a plurality of guides 162. The two posts 156 are typically positioned proximate the clamp base 176 and spaced to align with two post receivers 141 of mounting bodies 45, 55, or surface mount 951. The two posts 156 are sized to fit within and engage the post receivers 141 of mounting bodies 45, 55, or surface mount 951. In the embodiment shown in FIG. 34B, the posts 156 are substantially cylindrical. In other embodiments, the posts 156 may comprise a narrowing cylindrical shape, rectangular prism, or any other shape configured to complement the post receivers 141. The bottom surface 188 of the mounting clamp 150 may further comprise a non-planar portion in the clamp base 176 configured to at least partially compliment the base 44 of mounting bodies 45, 55, or surface mount 951 (shown in FIGS. 35-39).

As shown in FIG. 34B, embodiments of the mounting clamp 150 may comprise a plurality of guides extending from the bottom surface 188 of the mounting clamp 150. In some embodiments, one or more guides 162 are positioned between the coupling hole 152 and the clamp base 176, and one or more guides 162 are positioned on an edge of the clamp head 160 on an opposite side of coupling hole 152. As shown in FIGS. 36-39, the guides 162 act to guide the mounting clamp 150 along a channel 178 of a track 180. A threaded washer 182 in conjunction with a threaded coupling 180 allows the mounting clamp 150 to removably couple to the track 180.

Figure 35A:
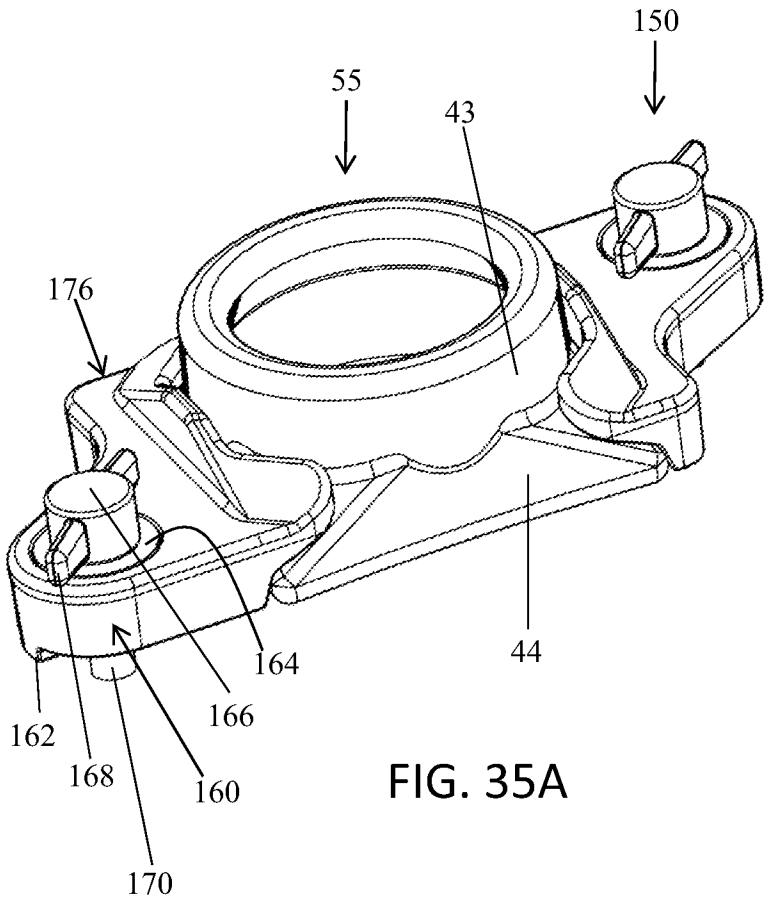
FIG. 35A is a perspective view of a two mounting clamps coupled to a mounting body.
Figure 35C:
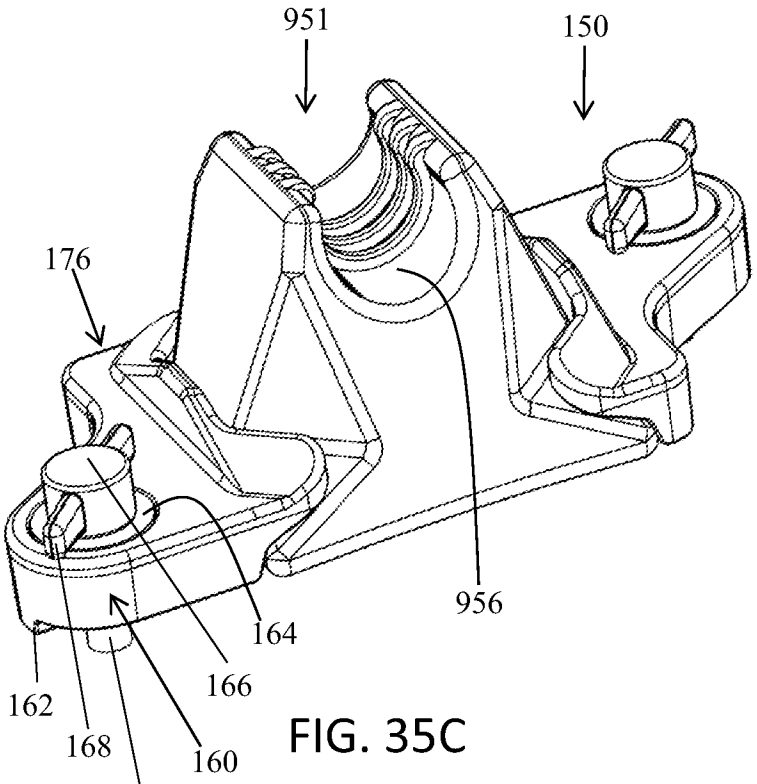
FIG. 35C is a perspective view of two mounting clamps coupled to a surface mount in a second position.
Figure 35B:
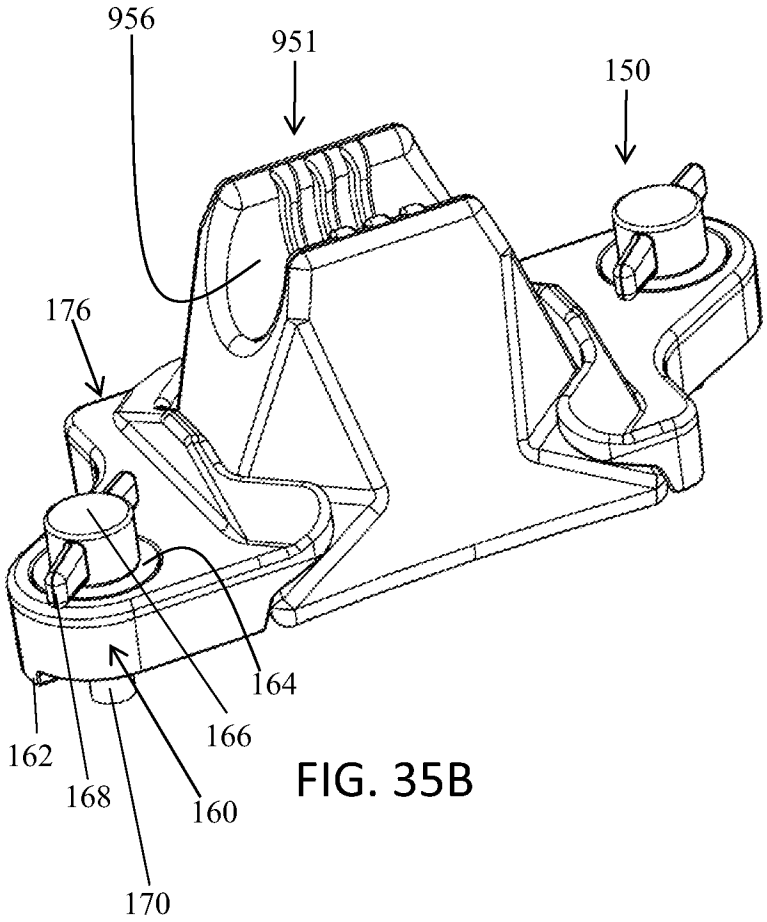
FIG. 35B is a perspective view of two mounting clamps coupled to a surface mount in a first position.
Figure 38:
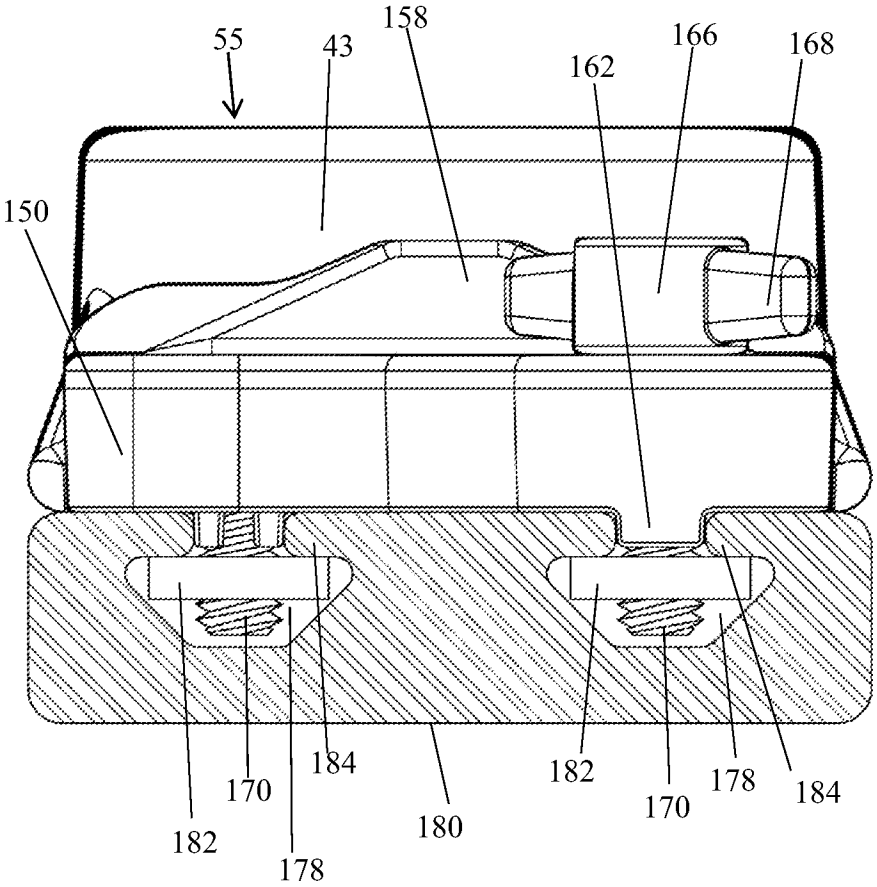
FIG. 38 is an end view of a mounting clamp coupled to a track and a mounting body.

FIG. 35A-C illustrates an embodiment of the mounting clamp 150 positioned with various embodiments of mounting bodies or surface mounts. Although no track 180 is shown in FIGS. 35A-C, the mounting clamps 150 are positioned adjacent to the mounting bodes or surface mounts as they would be if a track 180 were present. As shown in FIGS. 35A-C, threaded coupling 170 is positioned to extend through coupling hole 152. The threaded coupling 170 may comprise a coupling head 166 and coupling grips 168 in an embodiment. In other embodiments, the threaded coupling 170 comprises a flat, Phillips, or any other head that allows a user to rotate the threaded coupling 170. As shown in FIG. 38, a threaded washer 182 may be threadedly coupled to the threaded coupling 170 with the mounting clamp 150 positioned between the threaded washer 182 and the coupling head 166. Rotation of the coupling head 166 rotates the threaded coupling 170, thus moving the threaded washer 182 up or down along the threaded coupling, dependent upon directional rotation of the coupling head 166. As shown in FIG. 38, this allows a user to removably couple the mounting clamp 150 at various positions along the track 180 by clamping the lips 184 of channel 178 between the bottom surface 188 of the mounting clamp 150 and the threaded washer when the mounting clamp 150 is in a locked position. A washer 164 may also be inserted in the washer cavity 154 between the coupling head 166 and the top surface 194 of the mounting clamp 150.

In FIG. 35A, the mounting body 55 is shown removably coupled to two mounting clamps 150. The mounting body 45 may be similarly removably coupled with little or no variation. As shown, the clamp bases 176 of the mounting clamps 150 complement the mounting base 44 of mounting body 55 when the posts 156 are within the post receivers 141 (not visible), leaving the cylindrical body 43 positioned between the clamp bases 176 of the two mounting clamps 150. Similarly, FIGS. 35B and 35C illustrate two mounting clamps 150 removably coupled to surface mount 951. In FIG. 35B, the surface mount 951 is positioned such that the curved slot 956 runs substantially parallel to the position of a channel 178 between the two mounting clamps. In FIG. 35C, the surface mount 951 has been rotated such that the curved slot 956 runs substantially perpendicular to the position of a channel 178. Such a configuration is advantageous because it allows for different positioning of the surface mount 951 on the track 180 dependent upon the desired use.

Figure 36:
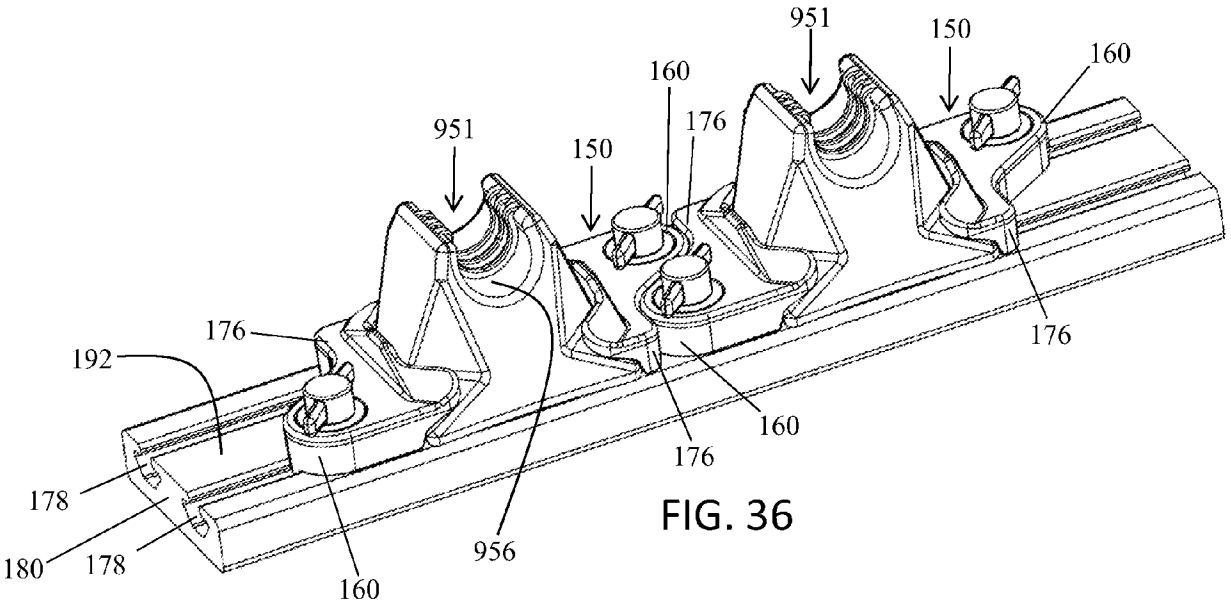
FIG. 36 is a perspective view of two surface mounts coupled to a track with a plurality of mounting clamps.

FIG. 36 illustrates two surface mounts 951 removably coupled to track 180 with mounting clamps 150. Mounting bodies 45, 55 may be similarly coupled to the track 180 with little or no variation. The track 180 typically comprises two parallel channels 178 each positioned to hold a different threaded coupling 170 of two clamps 150 when the mounting clamps 150 are placed back-to-back next to each other or the posts 156 of the two clamps 150 are within post receivers 141. FIGS. 36 and 38 also illustrate the lips 184 on each channel that allow mounting clamps 150 to be clamped at any position along the channel 178 of track 180.

Figure 37:
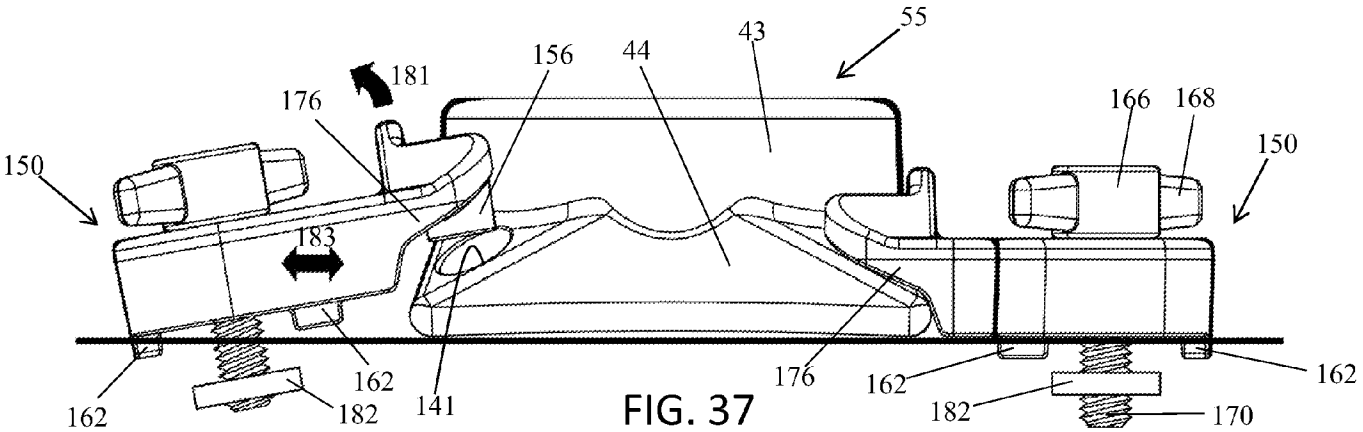
FIG. 37 is a first side view of mounting body coupled to a first mounting clamp and removal of a second mounting clamp from the mounting body.

FIG. 37 illustrates a mounting body 55 with two mounting clamps 150 along a plane similar to the top surface 192 of the track 180. As shown by arrow 181, the threaded coupling 170 is loosened, the mounting clamp 150 may pivot to remove the posts 156 from post receivers 141, while threaded coupling 170 and threaded washer 182 remain in the channel 178. Arrow 183 illustrates the directional movement of the mounting clamp 150 along the track 180 when the threaded coupling 170 is loosened.

FIG. 38 illustrates an end view of the mounting track 180, mounting clamp 150, and mounting body 55. As previously described, when tightened, the threaded coupling 170 clamps the lips 184 of the channels 178 between the bottom surface 188 of the mounting clamps 150 and the threaded washers 182. The guides 162 are sized and positioned to fit between the lips 184 of the channels 178. The guides 162 are also positioned to guide the mounting clamp along the channel 178 when the mounting clamp 150 is in a slidable unlocked position.

Figure 39:
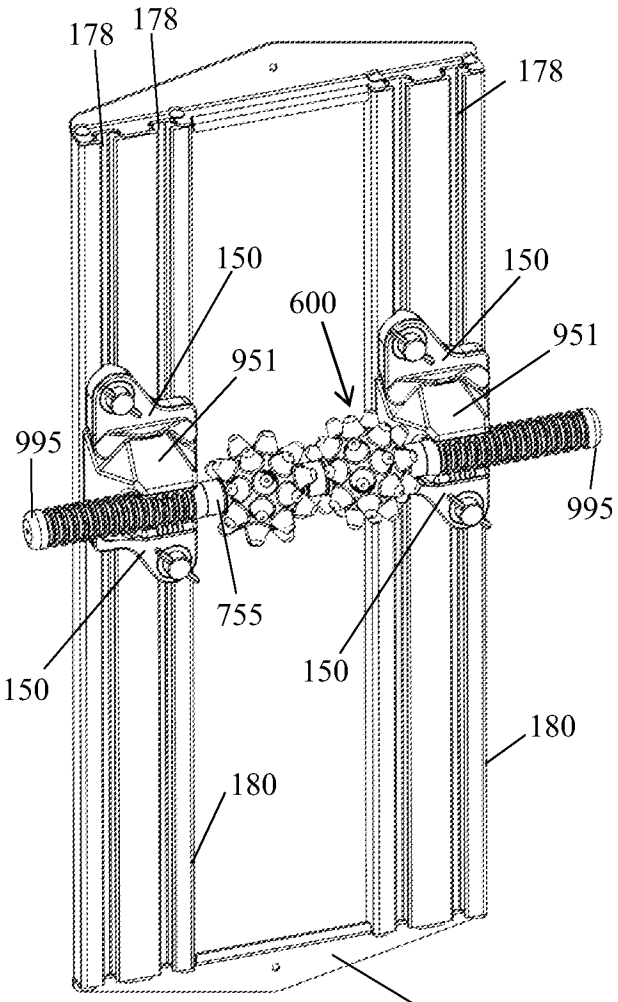
FIG. 39 is a perspective view a massage apparatus mounting system that includes tracks, mounting clamps, and surface mounts.

FIG. 39 illustrates a massage device mounting system comprising two tracks 180 and two supports 186 coupled to opposing ends of the tracks 180. The supports 186 and/or tracks 180 may be mounted to a wall in various systems. As previously described, the mounting clamps 150 are movable along the channels 178 of the tracks 180, thus allowing for adjustment of the position of the massage apparatuses 600 to meet the needs of different users. In the system shown in FIG. 39, a massage bar 750 (not visible) with sleeve 755 extends substantially perpendicular between the two tracks 180. In another embodiment, a plurality of massage bars 750 may be mounted to the tracks 180. In still other embodiments, the surface mounts 951 may be rotated such that the massage bar 750 runs substantially parallel to channels 178 along a single track 180.

It will be understood that implementations are not limited to the specific components disclosed herein, as virtually any components consistent with the intended operation of a method and/or system implementation for massage apparatuses may be utilized. Accordingly, for example, although particular massage apparatuses may be disclosed, such components may comprise any shape, size, style, type, model, version, class, grade, measurement, concentration, material, weight, quantity, and/or the like consistent with the intended operation of a method and/or system implementation for massage apparatuses may be used.

In places where the description above refers to particular implementations of massage apparatuses, it should be readily apparent that a number of modifications may be made without departing from the spirit thereof and that these implementations may be applied to other massage apparatuses. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A massage device mounting system, comprising:

a massage ball comprising a plurality of flexible massage fingers, each massage finger comprising a center axis central to an outward tip of the massage finger and extending to a center of the massage ball;

a mounting body comprising a mounting shoulder removably entrapped between a plurality of fingers of the plurality of flexible massage fingers, the mounting shoulder comprising an inner boundary that surrounds at least a majority of a portion of the massage ball;

wherein the plurality of flexible massage fingers comprises at least six massage fingers, and wherein the mounting shoulder is removably entrapped on the massage ball between at least three fingers of the at least six massage fingers directly contacting the inner boundary of the mounting shoulder and at least three additional fingers of the at least six massage fingers directly contacting an outer surface of the mounting shoulder.

2. The massage device mounting system of claim 1, wherein the plurality of massage fingers comprises thirty-two massage fingers and each center axis is positioned to correspond to a location of a different one of thirty-two vertices of a pentakis dodecahedron.

3. The massage device mounting system of claim 1, further comprising at least one handle coupled to the mounting body.

4. The massage device mounting system of claim 3, wherein the mounting shoulder comprises a continuous ring and the at least one handle comprises two handles on opposing sides of the continuous ring.

5. The massage device mounting system of claim 4, wherein the mounting body comprises a cylindrical mounting body coupled to the continuous ring of the mounting shoulder.

6. The massage device mounting system of claim 3, wherein the mounting shoulder comprises a discontinuous ring and the at least one handle comprises one handle coupled to the discontinuous ring.

7. The massage device mounting system of claim 6, wherein the handle comprises a J-shaped element with a first end coupled to the discontinuous ring and a terminating end opposite the base.

8. The massage device mounting system of claim 7, further comprising a hook on the terminating end of the J-shaped element and a reentrant opening on the J-shaped element positioned between the terminating end and the first end.

9. The massage device mounting system of claim 7, wherein the discontinuous ring comprises a substantially circular discontinuous ring.

10. The massage device mounting system of claim 1, wherein the discontinuous ring comprises a polygonal discontinuous ring.

11. The massage device mounting system of claim 1, wherein the mounting body comprises a substantially planar mounting plate with an opening defined by the inner boundary of the mounting shoulder.

12. The massage device mounting system of claim 1, wherein the mounting body is positioned on a mounting base.

13. The massage device mounting system of claim 12, wherein the mounting base comprises a plurality of post receivers and the system further comprises:

at least one mounting track comprising at least one channel; and at least one mounting clamp comprising:

at least one post sized to fit within at least one of the plurality of post receivers;

a rotatable threaded coupling extending through the mounting clamp;

a threaded washer threadedly coupled to the threaded coupling and configured to clamp lips of the at least one channel between a bottom surface of the mounting clamp and the threaded coupling when the mounting clamp is in a locked position and the at least one post is within the at least one of the plurality of post receivers, and engage the lips to prevent separation of the mounting clamp from the track when the mounting clamp is in a slidable unlocked position;

one or more guides extending from the bottom surface of the mounting clamp, the one or more guides positioned to fit between the lips of the at least one channel.

14. The massage device mounting system of claim 13, wherein the mounting body further comprises a cylindrical mounting body extending from the base to a massage apparatus mounting shoulder opposite the base.

15. The massage device mounting system of claim 12, wherein the mounting shoulder comprises a continuous ring and the mounting base extends from the mounting shoulder to form a mounting chamber, the mounting base further comprising a coupling opposite the mounting shoulder.

16. The massage device mounting system of claim 15, wherein the mounting base further comprises a plurality of finger apertures extending through the mounting base, each finger aperture positioned to allow a different massage finger of the plurality of massage fingers to extend therethrough when the massage ball is entrapped within the mounting shoulder.

17. The massage device mounting system of claim 12, wherein the mounting shoulder comprises a circular ring positioned on a cylindrical body of the base.

18. The massage device mounting system of claim 17, wherein the circular ring comprises a discontinuous ring comprising a plurality of segments separated by a plurality of reentrant openings, each reentrant opening sized to allow passage of one of the plurality of massage fingers through the mounting shoulder.

19. A massage device mounting system, comprising:

a mounting body comprising a massage apparatus mounting shoulder comprising an inner boundary that surrounds at least a majority of a portion of a massage apparatus; and the massage apparatus comprising an array of flexible massage fingers positioned to removably entrap the mounting shoulder between at least a first plurality of massage fingers of the array of flexible massage fingers and a second plurality of massage fingers of the array of flexible massage fingers, each massage finger of the array of flexible massage fingers comprising a center axis central to an outward tip of the massage finger and extending to a center of the massage apparatus, each center axis positioned to correspond to a different vertex of a pentakis dodecahedron having the same center as the massage apparatus;

wherein the array of flexible massage fingers comprises at least six massage fingers, and wherein the mounting shoulder is removably entrapped on the massage apparatus between at least three fingers of the at least six massage fingers directly contacting the inner boundary of the mounting shoulder and at least three additional fingers of the at least six massage fingers directly contacting an outer surface of the mounting shoulder.

20. The massage device mounting system of claim 19, wherein the mounting body comprises a cylindrical mounting body coupled to the mounting shoulder.

21. The massage device mounting system of claim 20, further comprising two handles coupled to opposing sides of the cylindrical mounting body.

22. The massage device mounting system of claim 20, wherein the massage apparatus mounting device further comprises a mounting base coupled to the cylindrical mounting body opposite the mounting shoulder.

23. The massage device mounting system of claim 22, wherein the mounting base comprises a plurality of post receivers and the massage device mounting system further comprises:

a track comprising at least one channel;

a mounting clamp removably coupled to the track and removably coupled to the mounting base, the mounting clamp slidable within the at least one channel and comprising at least one post sized to engage with at least one of the plurality of post receivers.

24. The massage device mounting system of claim 23, wherein the mounting clamp further comprises:

a rotatable threaded coupling extending through the mounting clamp;

a threaded washer threadedly coupled to the threaded coupling and configured to clamp lips of the at least one channel between a bottom surface of the mounting clamp and the threaded coupling when the mounting clamp is in a locked position, and engage the lips to prevent separation of the mounting clamp from the track when the mounting clamp is in a slidable unlocked position and the at least one post is removed from the at least one of the plurality of post receivers; and one or more guides extending from the bottom surface of the mounting clamp, the one or more guides positioned to fit between the lips of the at least one channel.

25. The massage device mounting system of claim 22, wherein the mounting shoulder comprises a plurality of reentrant openings each positioned to allow one of the plurality of massage fingers to pass through the reentrant opening when the massage apparatus is inserted through the mounting shoulder.

26. The massage device mounting system of claim 19, wherein the mounting body comprises a semi-spherical mounting body that forms a mounting chamber proximate the mounting shoulder, the semi-spherical mounting body comprising a coupling positioned opposite the mounting shoulder.

27. The massage device mounting system of claim 26, wherein the semi-spherical mounting body further comprises a plurality of mounting finger apertures each positioned to allow one of the plurality of a massage fingers to extend therethrough when the massage apparatus is removably entrapped within the massage shoulder.

28. The massage device mounting system of claim 19, wherein the mounting body comprises a substantially planar mounting plate and the inner boundary of the mounting shoulder defines an opening extending through the mounting plate.

29. A massage device mounting system, comprising:

a massage apparatus comprising an array of at least six flexible massage fingers;

a mounting ring comprising a massage apparatus mounting shoulder comprising an inner boundary that surrounds at least a majority of a portion of the massage apparatus;

at least one handle coupled to the mounting ring;

the array of at least six flexible massage fingers being positioned to removably entrap the mounting shoulder between at least three fingers of the at least six flexible massage fingers directly contacting the inner boundary of the mounting shoulder and at least three additional fingers of the at least six flexible massage fingers directly contacting an outer surface of the mounting shoulder.

30. The massage device mounting system of claim 29, wherein the at least one handle comprises two handles coupled to opposing sides of the mounting ring.

31. The massage device mounting system of claim 29, wherein the at least one handle comprises a J-shaped element comprising a first end coupled to the mounting ring and a terminating end opposite the first end.

32. The massage device mounting system of claim 31, wherein the J-shaped element further comprises a hook on the terminating end and a reentrant opening positioned between the terminating end and the first end.

33. The massage device mounting system of claim 29, wherein the mounting ring comprises a substantially circular discontinuous ring.

34. The massage device mounting system of claim 29, wherein the mounting ring comprises a polygonal discontinuous ring.

* * * * *